US006718658B2

(12) United States Patent
Karasawa

(10) Patent No.: US 6,718,658 B2
(45) Date of Patent: Apr. 13, 2004

(54) SHOEMAKING METHOD AND SHOES

(76) Inventor: Midori Karasawa, Libest Yachiyomidorigaoka 522, 1068-2, Oowadshinden, Yachiyo-shi, Chiba (JP)

( * ) Notice: Subject to any disclaimer, the term of this patent is extended or adjusted under 35 U.S.C. 154(b) by 0 days.

(21) Appl. No.: 09/994,531

(22) Filed: Nov. 27, 2001

(65) Prior Publication Data

US 2003/0097770 A1 May 29, 2003

(51) Int. Cl.[7] ..... A43B 3/26
(52) U.S. Cl. ..... 36/97; 36/100
(58) Field of Search ..... 36/100, 101, 15, 36/97

(56) References Cited

U.S. PATENT DOCUMENTS

| | | | | | |
|---|---|---|---|---|---|
| 1,539,762 | A | * | 5/1925 | Mussabini | 36/97 |
| 2,497,175 | A | * | 2/1950 | Mantos | 36/97 |
| 2,523,449 | A | * | 9/1950 | Rosenzweig | 36/97 |
| 3,389,481 | A | * | 6/1968 | England | 36/97 |
| 3,997,985 | A | * | 12/1976 | Shiina | 36/97 |
| 4,120,103 | A | * | 10/1978 | Colby | 36/97 |
| 5,570,523 | A | * | 11/1996 | Lin | 36/100 |
| 5,659,980 | A | * | 8/1997 | Lin | 36/112 |
| 6,438,872 | B1 | * | 8/2002 | Chil et al. | 36/97 |

FOREIGN PATENT DOCUMENTS

| | | |
|---|---|---|
| JP | 63-15702 | 10/1988 |
| JP | 5-4902 | 1/1993 |
| JP | 3014857 | 6/1995 |
| JP | 3039093 | 4/1997 |
| JP | 11-18803 | 1/1999 |

* cited by examiner

*Primary Examiner*—Ted Kavanaugh
(74) *Attorney, Agent, or Firm*—Nields & Lemack

(57) ABSTRACT

The present invention provides a method for making ready-made shoes fitting individuals' foot shapes. This method includes the steps of forming a separate forefoot part and a separate rearfoot part, and connecting them detachably by means of a connecting means to form a shoe body. This makes it possible to easily produce sorts of shoes of different widths for each size by forming forefoot parts of different widths and/or rearfoot parts of different widths, selecting any of these parts of different widths and connecting the forefoot and rearfoot parts. This also makes it possible to easily produce sorts of shoes each pair of which has different sizes and/or widths, by forming forefoot parts of different sizes and/or widths and/or rearfoot parts of different sizes and/or widths, selecting any of these parts of different sizes and/or widths and connecting the forefoot and rearfoot parts.

6 Claims, 20 Drawing Sheets

SHOEMAKING METHOD AND SHOES

TECHNICAL FIELD

The present invention relates to a shoemaking method and shoes. More specifically, the invention relates to a method for easily manufacturing shoes fitting the shapes of the wearers' feet, and to the shoes manufactured by this method.

The shoes to which the present invention is applied are not limited to the shoes in a narrow sense, each of which has an upper for wholly covering the instep and heel of the foot, but include sandals and the like, each of which has one or more uppers for covering only part of the instep and/or heel of the foot.

BACKGROUND ART

In general, ready-made shoes, which are mass-produced at factories etc., are manufactured using a standard mold for each size. The shape of the standard mold is based on the average human foot shape. Commonly, conventional ready-made shoe products have only one width for each size for any of men, women and children. There are exceptional products of different widths for each size, but they are expensive and limited in design. On the other hand, individuals who buy and wear ready-made shoes have an infinite variety of foot shapes even if they have the same foot size. In particular, individuals' feet vary greatly in width. Consequently, shoes ready-made with standard molds, as stated above, and having only one width for each size may not fit the wearers various foot shapes.

Thus, conventional ready-made shoes may not fit the buyers' foot shapes fully in terms of shoe width etc. Therefore, even if one chooses a pair of shoes of his or her favorite design and/or color and the size that he or she thinks is optimum, it may not fit his or her feet. Consequently, when buying a pair of shoes, one may have to sacrifice any of its size, width, design, color, etc.

Even the exceptional ready-made shoes of different widths for each size may not fit the wearers each having different foot widths. Because the forefoot and rearfoot parts of these shoes are graded in width at the same rate, both parts fit the wearers' feet at a very low probability.

As a result, one has so far had to rely on a custom-made product to obtain a pair of shoes fitting his or her foot shape, and it has been thought substantially impossible in terms of costs, productivity, etc. that conventional ready-made shoes would fit the wearers' different foot shapes.

SUMMARY OF THE INVENTION

It is therefore an object of the present invention to solve the foregoing conventional problems and provide a method for making ready-made shoes that fit individuals' foot shapes.

This object can be achieved by the following means according to the present invention:

[1] A method for making a shoe including a forefoot upper, a rearfoot upper, a forefoot sole, a rearfoot sole and an innersole, the forefoot and rearfoot uppers being divisions on the front and rear sides, respectively, of the arch of the shoe body, the forefoot and rearfoot soles being other divisions on the front and rear sides, respectively, of the arch, the innersole being laid in the formed shoe body, the method comprising the steps of:

forming a forefoot part by joining the forefoot upper to the forefoot sole;

forming a rearfoot part by joining the rearfoot upper to the rearfoot sole; and forming the shoe body by connecting the forefoot and rearfoot parts by detachably connecting the uppers of the forefoot and rearfoot parts by means of connecting means and detachably connecting the soles of the forefoot and rearfoot parts by means of other connecting means.

[2] A method for making a shoe including a forefoot upper, a rearfoot upper, a forefoot sole, a rearfoot sole and an innersole, the forefoot and rearfoot soles being divisions on the front and rear sides, respectively, of the arch of the shoe body, the innersole being laid in the formed shoe body, the method comprising the steps of:

forming a forefoot part by joining the forefoot upper to the forefoot sole;

forming a rearfoot pert by joining the rearfoot upper to the rearfoot sole; and forming the shoe body by connecting the forefoot and rearfoot parts by detachably connecting the soles of the forefoot and rearfoot parts by means of connecting means.

[3] A method for making a shoe including a forefoot part, a rearfoot part and an innersole, the forefoot and rearfoot parts being divisions on the front and rear sides, respectively, of the arch of the shoe body, the innersole being laid in the formed shoe body, the method comprising the steps of:

forming the forefoot part by integrally molding a forefoot upper and a forefoot sole;

forming the rearfoot part by integrally molding a rearfoot upper and a rearfoot sole; and forming the shoe body by connecting the forefoot and rearfoot parts by detachably connecting the uppers of the forefoot and rearfoot parts by means of connecting means and detachably connecting the soles of the forefoot and rearfoot parts by means of other connecting means.

[4] A method for making a shoe including a forefoot part, a rearfoot part and an innersole, the forefoot and rearfoot parts being divisions on the front and rear sides, respectively, of the arch of the shoe body, the innersole being laid in the formed shoe body, the method comprising the steps of:

forming the forefoot,part by integrally molding a forefoot upper and a forefoot sole;

forming the rearfoot part by integrally molding a rearfoot upper and a rearfoot sole; and forming the shoe body by connecting the forefoot and rearfoot parts by detachably connecting the soles of the forefoot and rearfoot parts by means of connecting means.

It is another object of the present invention to provide shoes made by the foregoing methods and fitting individuals' foot shapes.

This object can be achieved by the following means according to the present invention:

[5] A shoe including a forefoot upper, a rearfoot upper, a forefoot sole, a rearfoot sole and an innersole, the forefoot and rearfoot uppers being divisions on the front and rear sides, respectively, of the arch of the shoe body, the forefoot and rearfoot soles being other divisions on the front and rear sides, respectively, of the arch, the innersole being laid in the formed shoe body, the shoe comprising:

a forefoot part formed by joining the forefoot upper to the forefoot sole;

a rearfoot part formed by joining the rearfoot upper to the rearfoot sole;

connecting means for detachably connecting the uppers of the forefoot and rearfoot parts;

connecting means for detachably connecting the soles of the forefoot and rearfoot parts; and the innersole laid in the shoe body formed by connecting the forefoot and rearfoot parts by means of the two connecting means.

[6] A shoe including a forefoot upper, a rearfoot upper, a forefoot sole, a rearfoot sole and an innersole, the forefoot and rearfoot soles being divisions on the front and rear sides, respectively, of the arch of the shoe body, the innersole being laid in the formed shoe body, the shoe comprising:

a forefoot part formed by joining the forefoot upper to the forefoot sole;

a rearfoot part formed by joining the rearfoot upper to the rearfoot sole;

connecting means for detachably connecting the soles of the forefoot and rearfoot parts; and the innersole laid in the shoe body formed by connecting the forefoot and rearfoot parts by means of the connecting means.

[7] A shoe including a forefoot part, a rearfoot part and an innersole, the forefoot and rearfoot parts being divisions on the front and rear sides, respectively, of the arch of the shoe body, the innersole being laid in the formed shoe body, the shoe comprising:

the forefoot part formed by integrally molding a forefoot upper and a forefoot sole;

the rearfoot part formed by integrally molding a rearfoot upper and a rearfoot sole;

connecting means for detachably connecting the uppers of the forefoot and rearfoot parts;

connecting means for detachably connecting the soles of the forefoot and rearfoot parts; and the innersole laid in the shoe body formed by connecting the forefoot and rearfoot parts by means of the two connecting means.

[8] A shoe including a forefoot part, a rearfoot part and an innersole, the forefoot and rearfoot parts being divisions on the front and rear sides, respectively, of the arch of the shoe body, the innersole being laid in the formed shoe body, the shoe comprising:

the forefoot part formed by integrally molding a forefoot upper and a forefoot sole;

the rearfoot part formed by integrally molding a rearfoot upper and a rearfoot sole;

connecting means for detachably connecting the soles of the forefoot and rearfoot parts; and the innersole laid in the shoe body formed by connecting the forefoot and rearfoot parts by means of the connecting means.

The present invention makes it possible to easily produce sorts of shoes of different widths for each size and a pair of shoes of different sizes and/or widths by forming some sorts of forefoot and/or rearfoot parts of different widths and/or the like and suitably combining them. It is therefore possible to provide ready-made shoes fitting individuals' foot shapes.

The present invention also makes it possible to provide shoes having plenty of design variations, by combining necessary sorts of forefoot and rearfoot parts of any materials and/or designs. It is therefore possible to freely vary the designs, colors and/or materials of the bodies of shoes for the wearers' tastes, making it possible to provide satisfactory shoes for personal use.

It is possible to anytime separate the forefoot and rearfoot parts of a shoe made by any one of the methods according to the present invention. Therefore, even if one of the forefoot and rearfoot parts is damaged or worn, it can be replaced easily.

The methods according to the present invention shorten the lead-time until the completion of shoes in comparison with the conventional methods. These methods reduce the loss of shoe parts, improving the yield of shoe production, because the shoes each have a small number of parts.

DETAILED DESCRIPTION OF THE INVENTION

Figure 1:
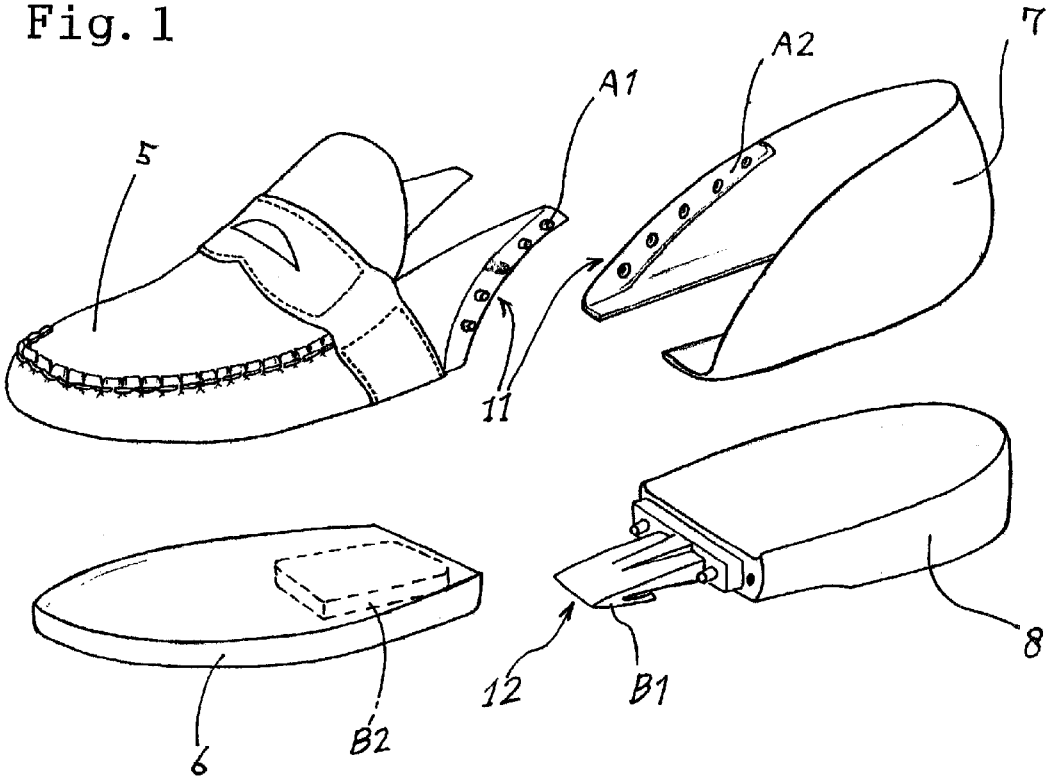
FIG. 1 is a perspective view of members of the shoe in an embodiment of a first aspect of the present invention, showing the members in a condition before production.
Figure 2:
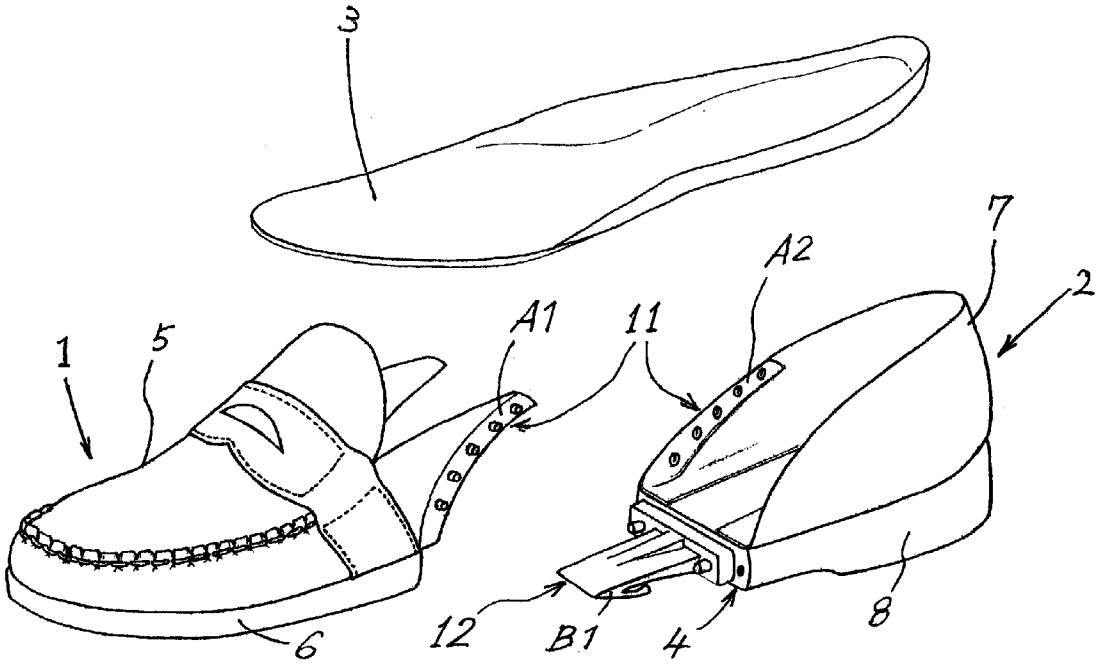
FIG. 2 is a perspective view of the forefoot part, the rearfoot part and the innersole in the embodiment shown in FIG.
Figure 3:
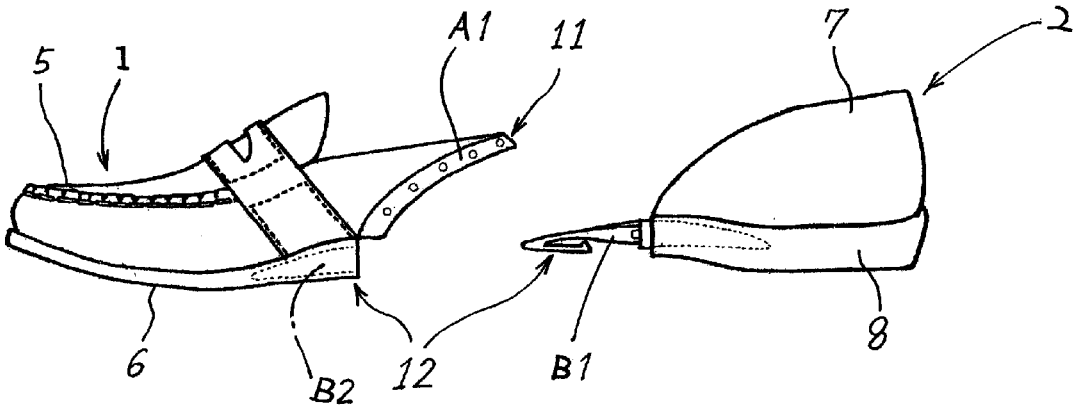
FIG. 3 is a side view of the forefoot and rearfoot parts in the embodiment shown in FIG. 1.
Figure 4:
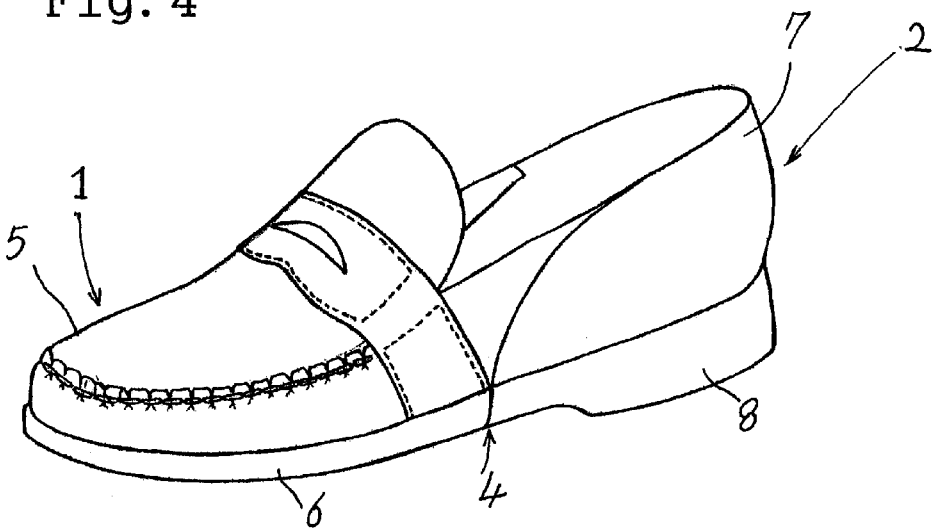
FIG. 4 is a perspective view of the shoe made in the embodiment shown in FIG. 1.
Figure 5:
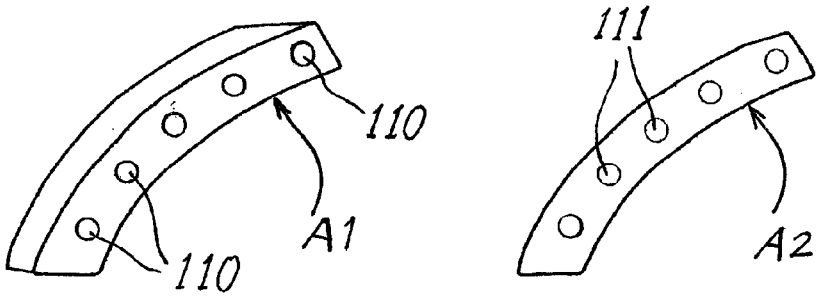
FIG. 5 is an explanatory view of a fastener for connecting the forefoot and rearfoot uppers in the embodiment shown in FIG. 1.
Figure 6:
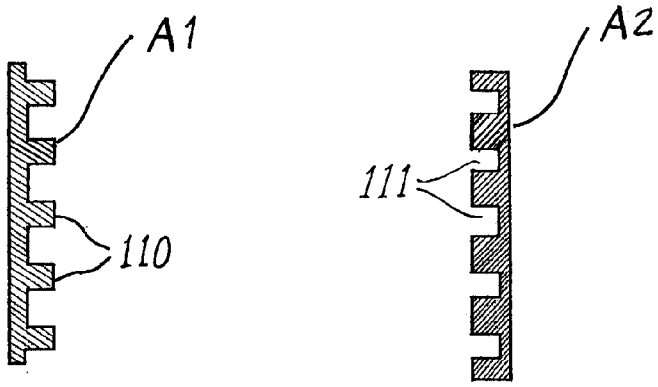
FIG. 6 is a longitudinal section of the fastener shown in FIG. 5.
Figure 7:
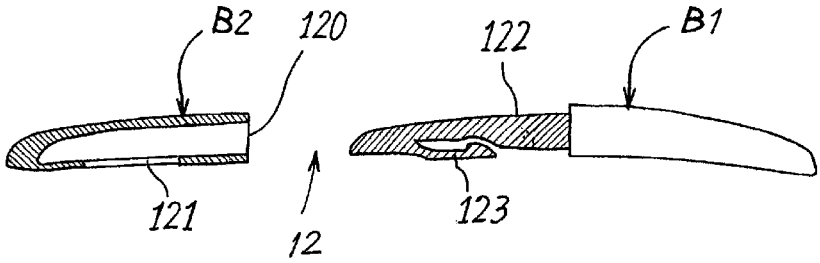
FIG. 7 is a side view partially in section of a fastener for connecting the forefoot and rearfoot soles in the embodiment shown in FIG. 1, and shows the fastener in disengaged condition.
Figure 8:
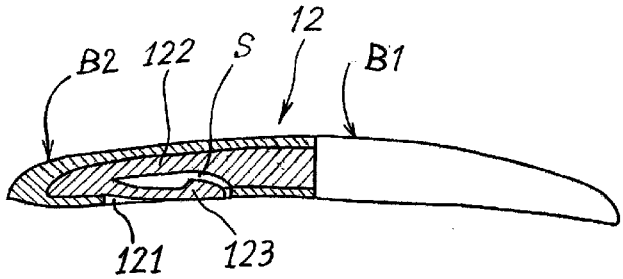
FIG. 8 is a side view partially in section of the fastener shown in FIG. 7, and shows the fastener in engaged condition.
Figure 9:
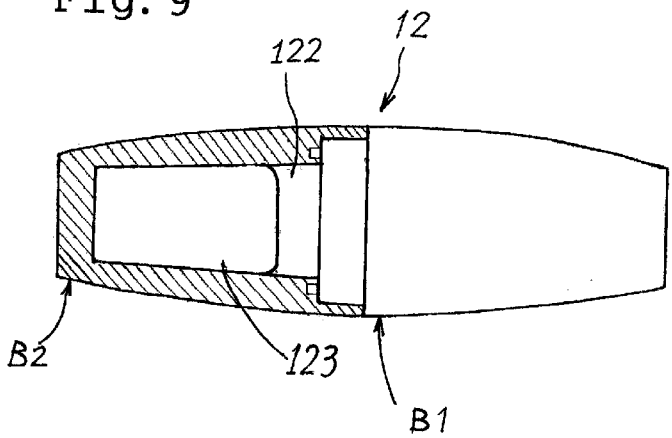
FIG. 9 is a bottom view partially in section of the fastener shown in FIG. 7, and shows the fastener in engaged condition.

FIGS. 1–9 shows an embodiment of a shoemaking method according to a first aspect of the present invention and a shoe made by this method. FIG. 1 is a perspective view of members of the shoe in a condition before production. FIG. 2 is a perspective view of the formed forefoot and rearfoot parts and the innersole of the shoe. FIG. 3 is a side view of the forefoot and rearfoot parts. FIG. 4 is a perspective view of the produced shoe (product). FIG. 5 is an explanatory view of a fastener for connecting the forefoot and rearfoot uppers of the shoe. FIG. 6 is a longitudinal section of the fastener. FIG. 7 is a side view partially in section of a fastener for connecting the forefoot and rearfoot soles of the shoe, and shows the fastener in disengaged condition. FIG. 8 is a side view partially in section of this fastener in engaged condition. FIG. 9 is a bottom view partially in section of this fastener in engaged condition.

The shoe shown in FIG. 1 consists of a forefoot upper 5, a rearfoot upper 7, a forefoot sole 6, a rearfoot sole 8 and an innersole 3 (FIG. 2). The uppers 5 and 7 are divisions on the front and rear sides of an arbitrary position in the arch (the middle 4 of the arch in this embodiment) of the shoe body. The soles 6 and sole 8 are other divisions on the front and rear sides of an arbitrary position in the arch (the middle 4 of the arch in this embodiment) of the shoe body. The innersole 3 is laid in the formed shoe body.

The forefoot and rearfoot uppers 5 and 7 may be made of resin or any other material.

The uppers 5 and 7 include fasteners 11 as connecting means each for detachably connecting their adjacent edges on one side. As shown in FIGS. 5 and 6, each fastener 11 consists of a male member Al and a female member A2. The male member A1 is provided along one of the adjacent edges on the associated side of the uppers 5 and 7 (the rear edge of the forefoot upper 5 in this embodiment). The female member A2 is provided along the other edge (the front edge of the rearfoot upper 7 in this embodiment). The male member A1 has protrusions 110 formed along the associated edge. The female member A2 has holes 111 formed along the associated edge. The protrusions 110 can detachably engage wits the holes 111 to detachably connect the edges of the uppers 5 and 7.

The male and female members A1 and A2 of the fasteners 11 may be made of metal, thermoplastic resin or any other material. These members A1 and A2 may be fixed to the forefoot and rearfoot uppers 5 and 7 by adhesion with an adhesive, stitching or any other means. The female members A2 might be holes formed directly through the upper 5 or 7. The structure, shape, etc. of the fasteners 11 are not limited to those shown in FIGS. 5 and 6, but may vary suitably with the material and design of the uppers 5 and 7. For example, the fasteners 11 might consist of magic tapes or zippers, parts of which are provided on the uppers 5 and 7. Alternatively, the fasteners 11 might consist of Mechanical connecting means for stronger connection.

The forefoot and rearfoot soles 6 and 8 may be made of resin (thermoplastic resin or thermosetting resin), synthetic rubber, natural rubber, leather or any other material for general shoe soles.

The soles 6 and 8 include a fastener 12 as a connecting means for detachably connecting their adjacent ends. As shown in FIGS. 7–9, the fastener 12 consists of a male member B1 and a female member B2. The female member B2 is provided in one of the adjacent ends of the soles 6 and 8 (the rear end of the forefoot sole 6 in this embodiment). The male member B1 is provided for the other end (the front end of the rearfoot sole 8 in this embodiment).

The female member B2 takes the form of a case having an open end 120, through which the male member B1 can be inserted into the female member B2. The female member B2 is fitted wholly into the forefoot sole 6, with its open end 120 positioned at that end of this sole 6 which should be connected to the rearfoot sole 8. The female member B2 has a hole 121 formed through its bottom for engagement with part (stopper) of the inserted male member B1.

The male member B1 includes a main body 122 and a rear part. The rear part is fitted into the rearfoot sole 8 so that the rearfoot sole 8 holds the male member B1, with the main body 122 protruding from that end of the rearfoot sole 8 which should be connected to the forefoot sole 6. The main body 122 has a stopper 123 in the form of a tongue extending from and under its bottom backward toward the rearfoot sole 8. The stopper 123 is spaced at a suitable distance "s" from the main body 122 so that it can elastically deform up and down around its front end.

The fastener 12 functions as the shank of the shoe sole. Therefore, the fastener 12 has such a shape and rigidity that it can function as the shank, and it is provided in those portions of the soles 6 and 8 which correspond to the shank. In order for the fastener 12 to function as the shank, its male and female members B1 and B2 need to have proper strength. Therefore, metal and thermoplastic resins are suitable materials for the male and female members B1 and B2.

The fastener 12 detachably connects the adjacent ends of the soles 6 and 8 together, with the main body 122 of its male member B1 inserted into the female member B2. The male member B1 is inserted into the female member B2, with its stopper 123 elastically deformed upward. When the main body 122 is inserted deepest into the female member B2, the stopper 123 is aligned with the bottom hole 121 of the female member B2. Then, the stopper 123 is released from elastic deformation and engages with the hole 121.

Consequently, the edge of the hole 121 stops the free end of the stopper 123. This prevents the male member B1 reliably from slipping out of the female member B2 even if pulling force acts on the male member B1.

The disengagement of the male member B from the female member B2 involves pressing the stopper 123 strongly from the underside of the shoe sole to elastically deform the stopper upward. This pushes the free end of the stopper 123 out of engagement with the hole 121 so that the male member B can be pulled easily out of the female member B2.

The structure, shape, etc. of the fastener 12 are not limited to those shown in FIGS. 7–9, but may be arbitrary. In any case, however, it is preferable that the fastener 12 could function as the shank.

A process according to this method for fabricating a shoe from members as mentioned above is described below. First, the forefoot upper 5 is joined to the forefoot sole 6 so that a forefoot part 1 can be formed. In the meantime, the rearfoot upper 7 is joined to the rearfoot sole 8 so that a rearfoot part 2 can be formed. The uppers 5 and 7 can be joined to the sales 6 and sole 8, respectively, by any method, which may normally be adhesion with an adhesive, connection with screws, or stitching. However, because the rearfoot sole 8 wears more quickly than the other shoe parts, it is particularly preferable that the rearfoot upper 7 be joined to the rearfoot sole 8 with screws so that the rearfoot sole can be replaced easily.

The male and female members A1 and A2 of the fasteners 11 are fixed in advance to the uppers 5 and 7. The male and female members B1 and B2 of the fastener 12 may be fixed in advance to the soles 8 and 6. Alternatively, when the uppers 5 and 7 are joined to the soles 6 and 8, respectively, the male and female members B1 and B2 may be fixed to the soles 8 and 6.

By the foregoing process, the forefoot and rearfoot parts 1 and 2 are formed that are the divisions of the shoe body on the front and rear sides of the arch (the middle 4 of the arch in this embodiment) of the shoe sole, as shown in FIGS. 2 and 3.

Subsequently, the male and female members A1 and A2 of the fasteners 11 are engaged to detachably connect the adjacent edges of the uppers 5 and 7. In the meantime, the male and female members B1 and B2 of the fastener 12 are engaged to detachably connect the adjacent ends of the soles 6 and 8. This connects the forefoot and rearfoot parts 1 and 2 together, forming the shoe body. Next, the innersole 3 is laid in the shoe body. This completes the shoe as shown in FIG. 4.

The foregoing is an embodiment of the shoemaking process according to this method. Ready-made shoes fitting an individual's foot shape can be made as follows. The production of shoes of an arbitrary size involves forming (making) forefoot parts 1 of different widths and/or rearfoot parts 2 of different widths. The production also involves selecting any of the parts 1 and/or 2 of different widths and connecting the parts land 2 as stated above. This makes it possible to produce sorts of shoes of different widths for each size. By way of example, if five sorts of forefoot parts 1 of different widths and three sorts of rearfoot parts 2 of different widths are made, it is possible to produce fifteen sorts of shoes of different widths for each size.

The production of a pair of shoes of different sizes and/or widths involves forming (making) forefoot parts 1 of different sizes and/or widths and/or rearfoot parts 2 of different sizes and/or widths. The production also involves selecting any of the parts 1 and/or 2 of different sizes and/or widths and connecting the parts 1 and 2 as stated above. This makes it possible to produce sorts of shoes each pair of which has different sizes and/or widths.

Thus, this method makes it possible to easily produce sorts of shoes of different widths for each size and a pair of shoes of different sizes and/or widths by forming some sorts of forefoot parts 1 and/or rearfoot parts 2 of different widths and/or the like and suitably combining them.

The forefoot and rearfoot parts 1 and 2 of each shoe made by this method can be separated anytime. Even if one of the parts 1 and 2 is damaged or worn, it can be replaced easily.

All of the uppers 5 and 7 and soles 6 and 8 of each shoe may be made of resin. The resinous uppers 5 and 7 may be joined to the resinous soles 6 and 8, respectively, with an adhesive so that a forefoot part 1 and a rearfoot part 2, respectively, may be formed. In this case, if any of the uppers 5 and 7 and soles 6 and 8 is damaged or worn, its adhesive joint can be torn off for replacement of it.

Figure 10:
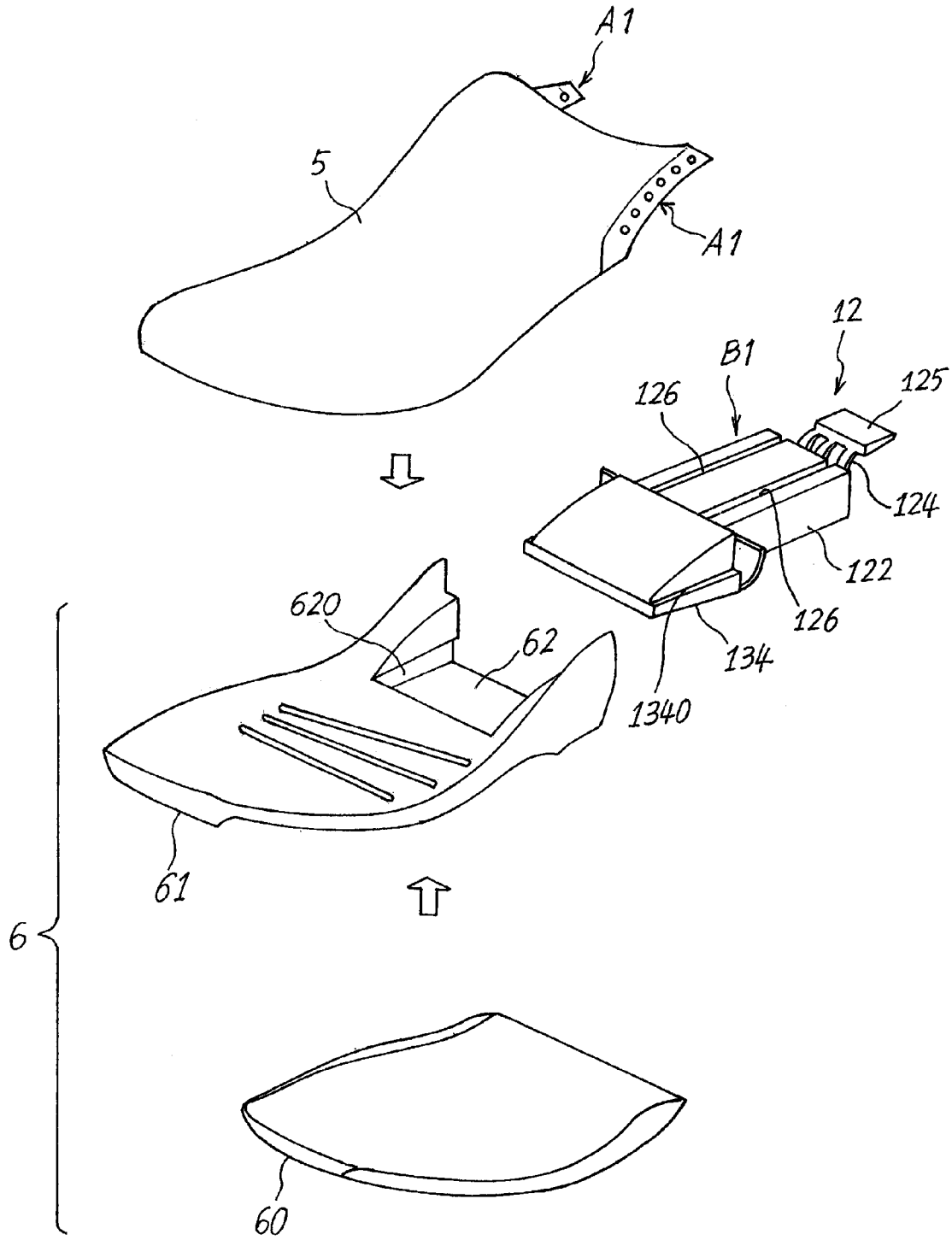
FIG. 10 is a perspective view of the members of the forefoot part of the shoe in another embodiment of the first aspect of the present invention, showing the members in a condition before production.
Figure 11:
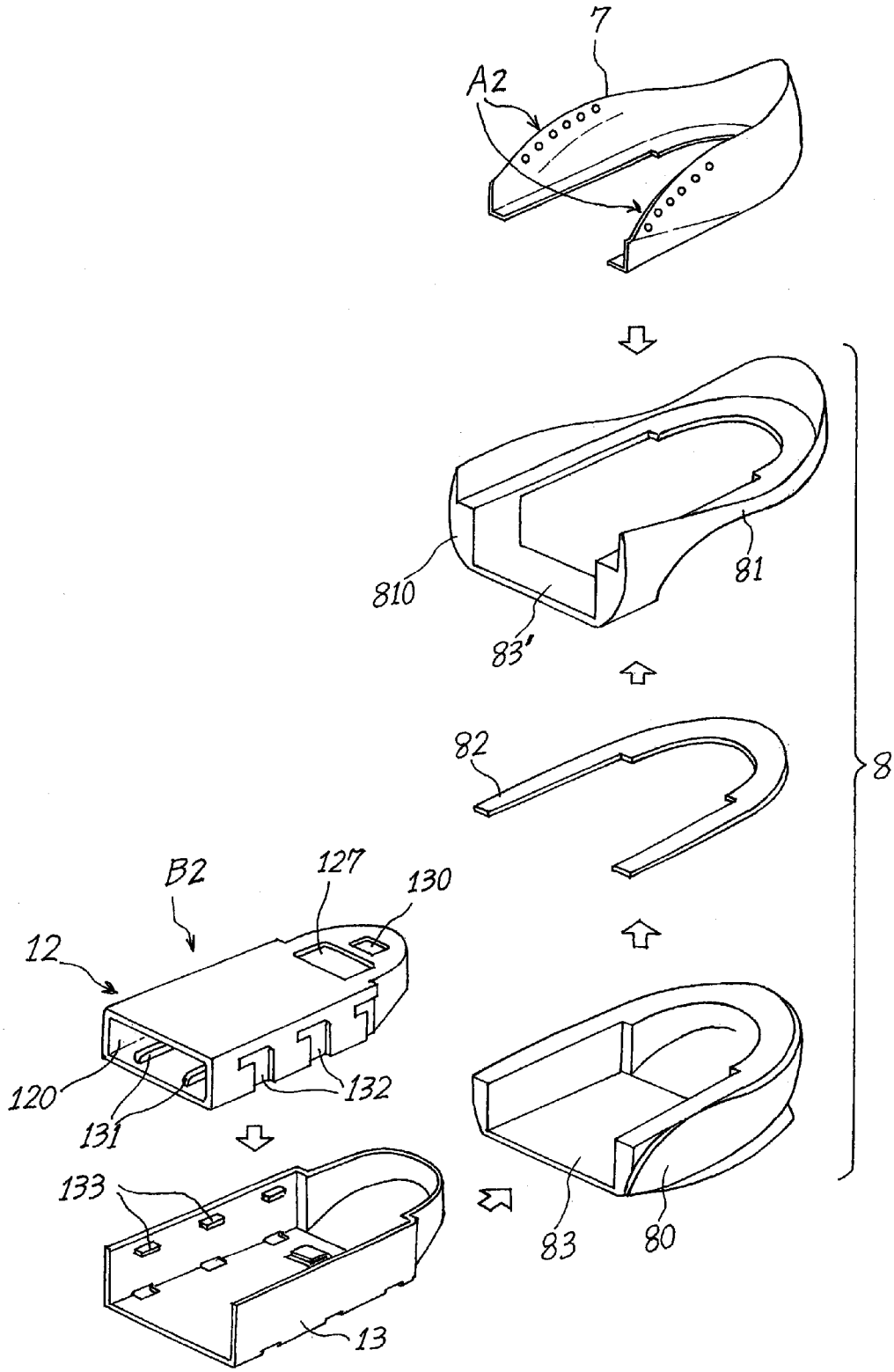
FIG. 11 is a perspective view of the members of the rearfoot part of the shoe in the embodiment shown in FIG. 10, and shows the members in a condition before production.
Figure 12:
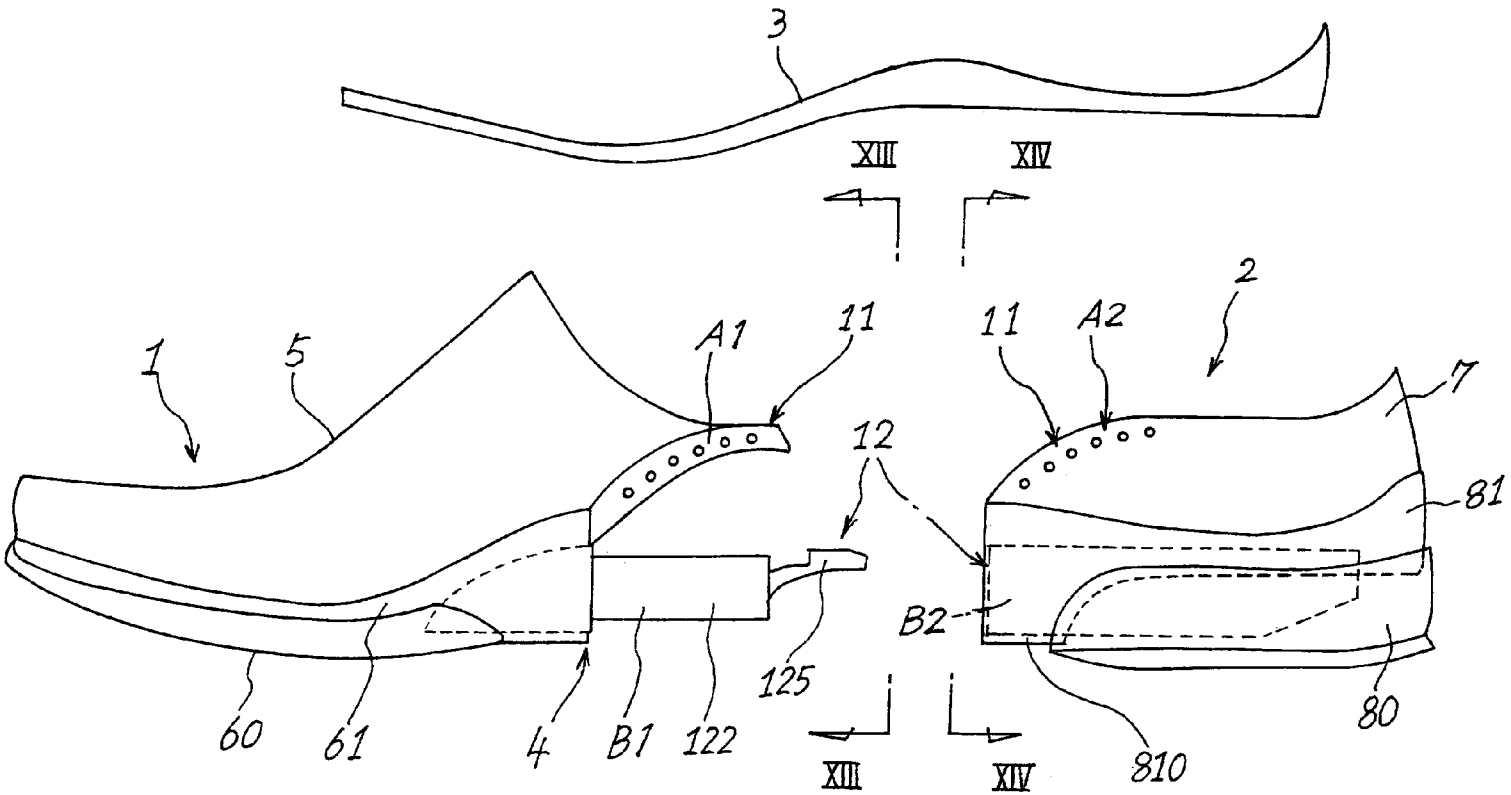
FIG. 12 is a side view of the forefoot and rearfoot parts and the innersole in the embodiment shown in FIG. 10.
Figure 13:
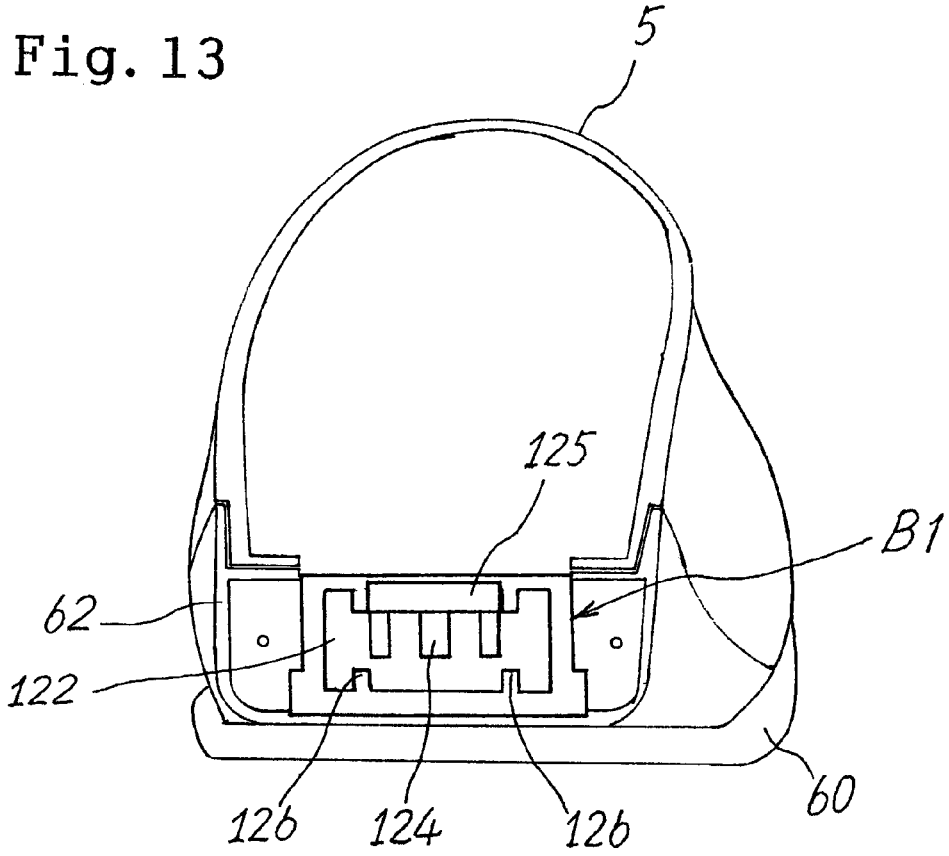
FIG. 13 is a view taken along the line XIII—XIII of FIG. 12.
Figure 14:
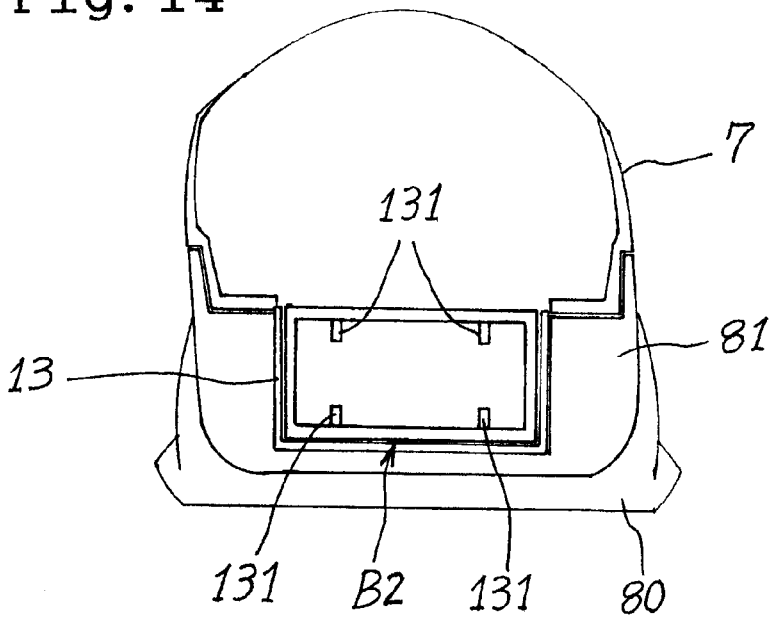
FIG. 14 is a view taken along the line XIV—XIV of FIG. 12.
Figure 15:
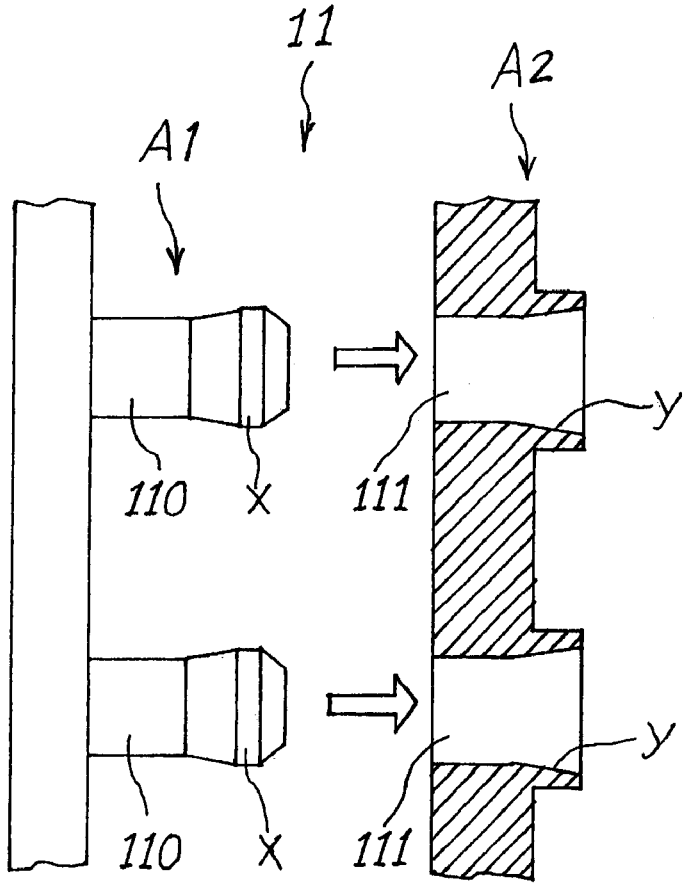
FIG. 15 is an explanatory view of a fastener for connecting the forefoot upper and the rearfoot upper in the embodiment shown in FIG. 10.
Figure 16:
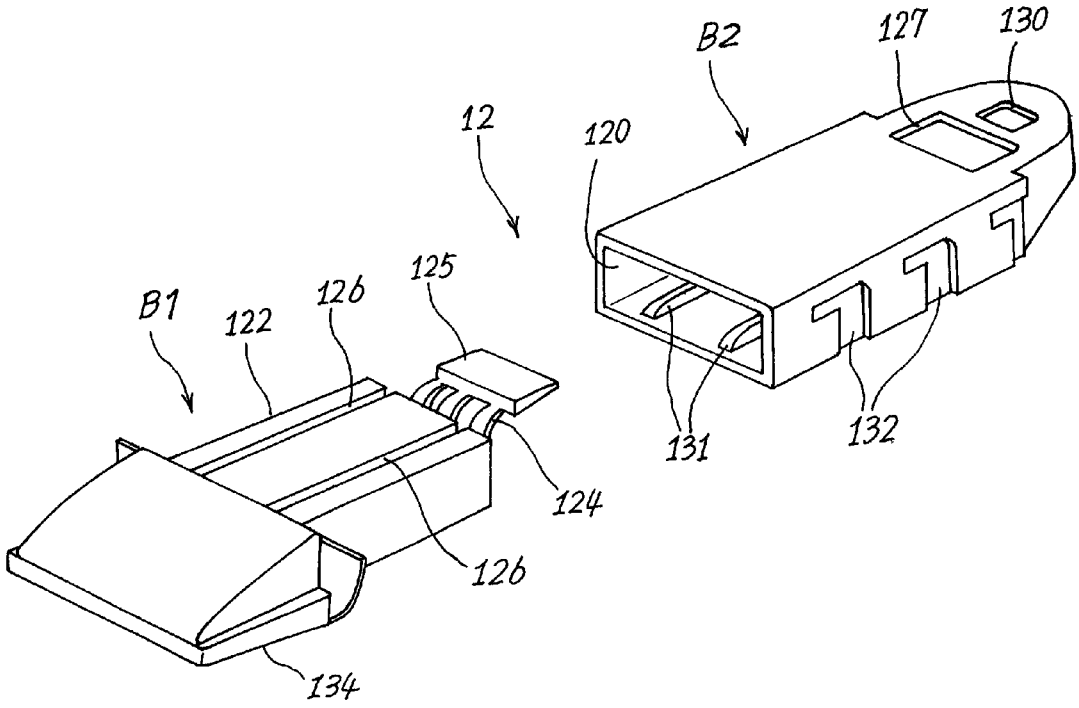
FIG. 16 is a perspective view of a fastener for connecting the forefoot and rearfoot soles in the embodiment shown in FIG. 10, and shows the fastener in disengaged condition.
Figure 17:
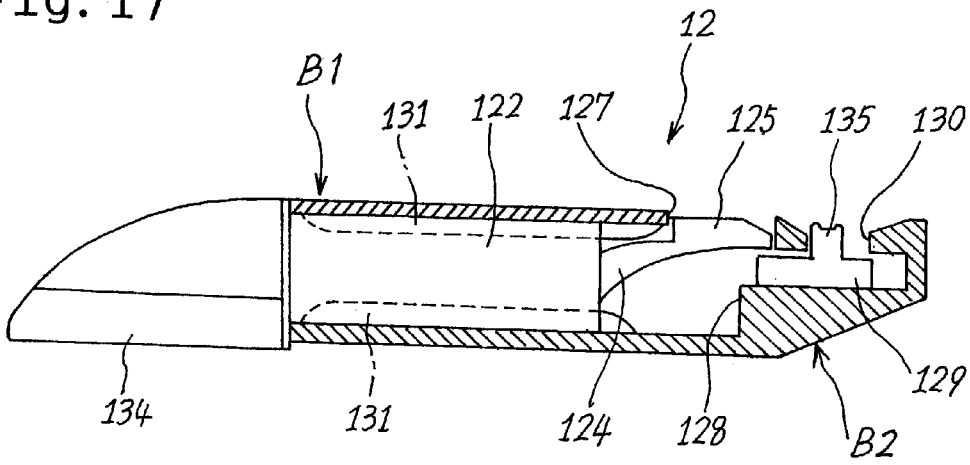
FIG. 17 is a side view partially in section of the fastener shown in FIG. 16, and shows the fastener in engaged condition.
Figure 18:
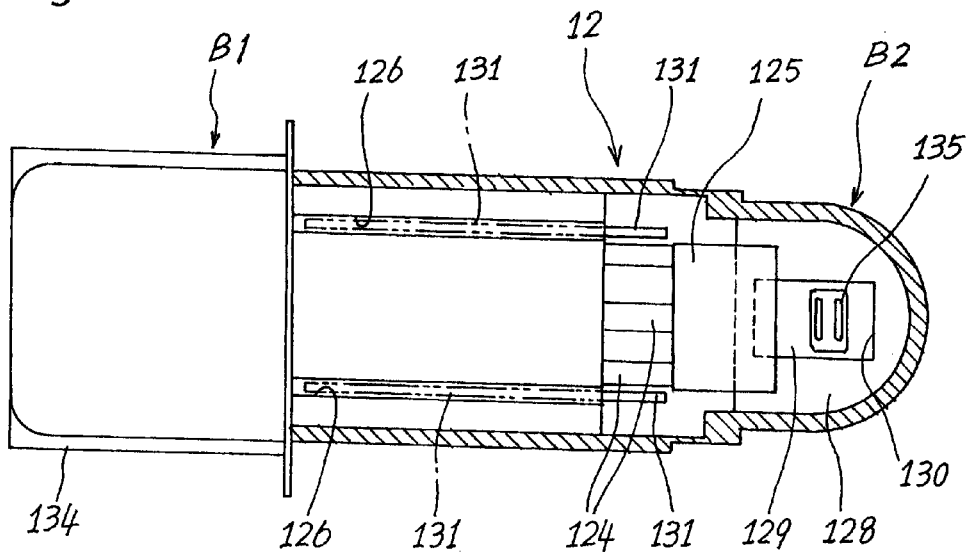
FIG. 18 is a plan view partially in section of the fastener shown in FIG. 16, and shows the fastener in engaged condition.

FIGS. 10–18 show another embodiment of a shoemaking method according to the first aspect of the present invention and a shoe made by this method. FIG. 10 is a perspective view of the members of the forefoot part of the shoe in a condition before production. FIG. 11 is a perspective view of the members of the rearfoot part of the shoe in the same condition. FIG. 12 is a side view of the formed forefoot and rearfoot parts and the innersole of the shoe. FIG. 13 is a view taken along the line XIII—XIII of FIG. 12. FIG. 14 is a view taken along the line XIV—XIV of FIG. 12. FIG. 15 is an explanatory view of a fastener for connecting the forefoot and rearfoot uppers of the shoe. FIG. 16 is a perspective view of a fastener for connecting the forefoot and rearfoot soles of the shoe in disengaged condition. FIG. 17 is a side view partially in section of this fastener in engaged condition, showing only the female member in section. FIG. 18 is a plan view partially in section of this fastener in the same condition, showing only the female member in horizontal section.

The shoe shown in FIGS. 10 and 11 consists of a forefoot upper 5, a rearfoot upper 7, a forefoot sole 6, a rearfoot sole 8 and an innersole 3 (FIG. 12). The uppers 5 and 7 are divisions on the front and rear sides of a position in the arch (the middle 4 of the arch in this embodiment) of the shoe body. The soles 6 and 8 are other divisions on the front and rear sides of a position in the arch (the middle 4 of the arch in this embodiment) of the shoe body. The innersole 3 is laid in the formed shoe body.

The forefoot sole 6 of this shoe consists of a forefoot outsole 60 and a forefoot midsole 61. The rearfoot sole 8 of this shoe consists of a rearfoot outsole 80, a rearfoot midsole 81 and a sole fixing plate 82, which is interposed between them.

The uppers 5 and 7 include fasteners 11 as connecting means each for detachably connecting their adjacent edges on one side. The fasteners 11 are similar to those of the embodiment shown in FIGS. 1–9. Each fastener 11 consists of a male member A1 and a female member A2. The male member A1 is provided along one of the adjacent edges on the associated side of the uppers 5 and 7 (the rear edge of the forefoot upper 5 in this embodiment). The female member A2 is provided along the other edge (the front edge of the rearfoot upper 7 in this embodiment). The male member A1 has protrusions 110 formed along the associated edge. The female member A2 has holes 111 formed along the associated edge. The protrusions 110 can detachably engage with the holes 111 to detachably connect the edges of the uppers 5 and 7.

FIG. 15 shows the specific structure of each of these fasteners 11. Each protrusion 110 of the male member A1 takes the form of a pin having a head "x", which is larger in diameter than the other part of the pin. Each hole 111 of the female member A2 has an inner portion "y", which is larger in diameter than the other portion of the hole to match the diameter of the pin head "x". The protrusion 110 can be forced into the hole 111, elastically deforming the inlet side of the hole. The head "x" of the protrusion 110 can engage with the inner portion "y" of the hole 111.

The male and female members A1 and A2 of the fasteners 11 may be made of metal, thermoplastic resin or any other material. These members A1 and A2 may be fixed to the uppers 5 and 7 by adhesion with an adhesive, stitching or any other means. The female members A2 might be holes formed directly through the upper 5 or 7.

The structure, shape, etc. of the fasteners 11 are not limited to those shown in FIG. 15, but may vary suitably with the material and design of the uppers 5 and 7. For example, the fasteners 11 might consist of magic tapes or zippers, parts of which are provided on the uppers 5 and 7. Alternatively, the fasteners 11 might consist of mechanical connecting means for stronger connection.

The materials etc. for the uppers 5 and 7 are similar to those for the embodiment shown in FIGS. 1–9.

The forefoot sole 6 shown in FIG. 10 consists of a forefoot outsole 60 as part of the essential sole and a forefoot midsole 61, which is positioned over the outsole. The forefoot upper 5 is joined to the midsole 61. The rear end of the midsole 61 is formed with a recess 62 for engagement with the male member B1 of a fastener 12, which will be mentioned later on. The top and the rear end of the recess 62 are open. The front end of the male member B1 can be inserted through the rear end of the recess 62 into the recess. The recess 62 has grooves 620 formed on both sides for engagement with both sides of the front end of the male member B1 so that the inserted end of the male member B1 can be held reliably in the recess 62.

The outsole 60 and midsole 61 of the forefoot sole 6 may be made of resin (thermoplastic resin or thermosetting resin) synthetic rubber, natural rubber, leather or any other material for general shoe soles.

The rearfoot sole 8 shown in FIG. 11 includes a rearfoot outsole 80 as part of the essential sole and a rearfoot midsole 81, which is positioned over the outsole with a sole fixing plate 82 interposed between them. The rearfoot upper 7 is joined to the midsole 81. The front end 810 of the midsole 81 joined to the outsole 80 protrudes forward beyond the front end of the outsole 80. The midsole end 810 and the outsole 80 are formed with recesses 83 and 83' in them for engagement with the female member B2 (pedestal 13) of the fastener 12, which will be mentioned later on.

The fixing plate 82 is interposed between the rearfoot outsole 80 and midsole 81 for the following reason. If the rearfoot upper 7 and midsole 81 were joined directly to the outsole 80 with screws screwed from above the upper 7, the outsole 80 might disengage from the screws, because the outsole 80 is generally made of rubber, which is weak in force of constraint (arresting force) for the screws. Therefore, the fixing plate 82 is made of plastic or the like, which is harder than rubber, and this plate 82 is joined to the top of the outsole 80 with an adhesive so that the plate 82 can constrain (arrest) the screws. Positioned on the fixing plate 82, the midsole 81 can be joined together with the upper 7 to the fixing plate 82 with the screws.

If an adhesive, not screws, were used to directly join the outsole 80 and midsole 81 together, and if these parts 80 and 81 were made of different materials, it might be impossible to join the parts directly with the adhesive due to the difference between the materials. In such a case, the fixing plate 82 may be made of a material that can be joined to the outsole 80 and midsole 81 with an adhesive. By interposing the fixing plate 82 of this material between the outsole 80 and midsole 81, it is possible to join the parts 80 and 81 with the adhesive.

Basically, the outsole 80, midsole 81 and fixing plate 82 of the rearfoot sole 8 may be made of any material. In the case of the screws being used, the fixing plate 82 may be made of resin (plastic), which is harder than rubber. In general, it is preferable that the outsole 80 be made of synthetic, natural or other rubber, and that the midsole 81 be made of plastic.

The forefoot and rearfoot soles 6 and 8 include a fastener 12 as a connecting means for detachably connecting their adjacent ends. The fastener 12 consists of a male member B1 and a female member B2. The female member B2 is provided in one of the adjacent ends of the soles 6 and 8 (the front end of the rearfoot sole 8 in this embodiment). The male member B1 is provided for the other end (the rear end of the forefoot sole 6 in this embodiment).

The male and female members B1 and B2 may be made of industrial plastic (for example, polyacetal) that is high in strength, shock (impact) resistance, abrasive resistance, etc. so that they can function as the shank of the shoe sole.

As shown in FIGS. 10 and 16–18, the male member B1 includes a front end part 134 and a main body 122. The end part 134 can engage with the recess 62 of the forefoot midsole 61 so that the forefoot sole 6 can hold the male member B1. The main body 122 of the male member B1 held by the forefoot sole 6 protrudes from that end of this sole 6 which should be connected to the rearfoot sole 8. The whole of the main body 122 is tubular and rectangular in cross section. The main body 122 has arms 124 connecting its rear end and a stopper 125 in the form of a flat plate. The arms 124 can elastically deform up and down. The main body 122 has longitudinal guide grooves 126 formed in its top and bottom, which can be guided by the ridges of the female member B2.

The front end part 134 of the male member B1 has a relatively large rectangular bottom for engagement with the bottom of the recess 62 of the forefoot midsole 61. The front end part 134 also has steps 1340 on both sides for engagement with the grooves 620 of the recess 62. The engagement of the large bottom and the steps 1340 with the recess 62 makes it possible to join the end part 134 securely to the midsole 61 and enables the fastener 12 to function as a proper shank. The top of the end part 134 is a slope, which is roughly flush with the top of the midsole 61 when this part 134 is inserted in the recess 62.

As shown in FIGS. 11 and 16–18, the female member B2 takes the form of a case. One end 120 of the female member B2 is open so that the main body 122 of the male member B1 can be inserted in the female member. The female member B2 is put wholly in the recess 83 of the rearfoot sole 8, with the pedestal 13 interposed and the open end 120 of the female member B2 positioned at that end of the rearfoot sole 8 which should be connected to the forefoot sole 6. The top of the female member B2 has a hole 127 formed through it near its other end for engagement with the stopper 125 of the inserted male member B1.

The female member B2 includes a supporting seat 128 formed in it, which has a horizontal sliding surface. The female member B2 also includes a stopper 129 supported on the sliding surface of the seat 128 in such a manner that it can slide longitudinally of the female member. This stopper 129 can engage with the bottom of the rear end of the stopper 125 of the male member B to hold the stopper 125 in the hole 127 of the female member B2. The stopper 129 of the female member B2 includes a knob or lug 135 formed on its top for sliding operation of this stopper. The top of the female member B2 has another hole 130 formed through it near the hole 127. The stopper knob 135 is positioned in this hole 130. By manipulating the knob 135 to slide the associated stopper 129 longitudinally of the female member B2, it is possible to bring the front end of this stopper 129 into and out of engagement with the bottom of the rear end of the stopper 125 of the male member B1.

The female member B2 has longitudinal ridges 131 formed on the inner sides of its top and bottom for engaging with the guide grooves 126 of the male member B1 to guide the male member.

The female member B2 also has inverted L grooves 132 formed on the outer sides of its sidewalls. The lower ends of the grooves 132 are open on the bottom side of the female member B2. The pedestal 13 has protrusions formed on its inside for engaging with the grooves 132 to fix the female member B2 mechanically and detachably to the pedestal 13.

As stated already, the fastener 12, which consists of the male and female members B1 and B2, according to this embodiment functions as the shank of the shoe sole. Therefore, the fastener 12 is made of the foregoing material and provided at the shank between the forefoot and rearfoot soles 6 and 8.

The fastener 12 detachably joins the adjacent ends of the forefoot and rearfoot soles 6 and 8, with the main body 122 of the male member B1 inserted in the female member B2. The main body 122 of the male member B1 is inserted in the female member B2, with the arms 124 of the male member elastically deformed. When the main body 122 is inserted deepest in the female member B2, the stopper 125 of the male member B1 reaches the hole 127 of the top of the female member B2. Then, the arms 124 are released from elastic deformation, bringing the stopper 125 into engagement with the hole 127. In this condition, the stopper 129 of the female member B2 engages with the bottom of the rear end of the stopper 125 of the male member B1 to hold this s topper 125 in the hole 127. This prevents the male member B1 reliably from coming out of the female member B2, because the front end of the hole 127 stops the front end of the stopper 125, even if pulling force acts on the male member B1.

It is possible to pull the male member B1 out of the female member B2 by manipulating the knob 135 to slide the stopper 129 of the female member away from the male member so that this stopper 129 disengages from the bottom of the rear end of the stopper 125 of the male member. In this condition, if the stopper 125 of the male member B1 is pressed downward from the inside of the shoe, the arms 124 elastically deform, disengaging this stopper 125 from the hole 127. This makes it easy to pull the male member B1 out of the female member B2.

The pedestal 13 wholly houses and holds the female member B2, and takes the form of a vessel open at its one end and top. The pedestal 13 has inward protrusions 133 formed on its sidewalls for detachable engagement with the grooves 132 formed on the outer sides of the female member B2. The female member B2 is fitted in the rearfoot sole 8 with the pedestal 13 interposed, and this member B2 and the pedestal 13 are mechanically detachably connected. One of the reasons for adopting this structure is that, when the rearfoot outsole 80 is replaced, the female member B2 can be removed for reuse.

The mechanical connection of the pedestal 13 and the female member B2 by means of grooves and protrusions, as stated already, may involve forming grooves 132 on one of the inside of the pedestal 13 and the outside of the female member B2, and protrusions 133 on the other.

The structure, shape, etc. of the fastener 12 are not limited to those shown in FIGS. 16–18, but may be arbitrary. In any case, however, it is preferable that the fastener 12 could function as the shank.

A process according to this method for fabricating a shoe from members as mentioned above is described below. The formation of the forefoot part 1 shown in FIG. 10 involves joining the forefoot outsole 60 and midsole 61 together, and joining the forefoot upper 5 to the forefoot midsole 61. In the meantime, the front end part 134 of the male member B1 of the fastener 12 is inserted into the recess 62 of the midsole 61 and bonded to it with an adhesive or fixed otherwise. The forefoot outsole 60, midsole 61 and upper 5 can be joined by any method, which may be adhesion with an adhesive, connection with screws or stitching. The easiest joining method is adhesion with an adhesive.

The formation of the rearfoot part 2 shown in FIG. 11 involves joining the rearfoot outsole 80 and midsole 81 with the fixing plate 82 interposed, and joining the rearfoot upper 7 to the rearfoot midsole 81. In the meantime, the pedestal 13 for the fastener 12 is fitted in the recesses 83 and 83' of the outsole 80 and the midsole 81, respectively. The pedestal 13 is joined and fixed (for example, bonded with an adhesive) to the outsole 80 only. The female member B2 is fixed detachably in the pedestal 13. The fixation of the female member B2 in the pedestal 13 involves putting this member B2 in the pedestal 13 with the inverted L grooves 132 in engagement with the inward protrusions 133, and then sliding the member B2 longitudinally of the pedestal 13 to relatively move the protrusions 133 to the front ends of the grooves 132. This causes the pedestal 13 to vertically constrain the female member B2, reliably preventing this member B2 from coming out of the pedestal 13.

Figure 19:
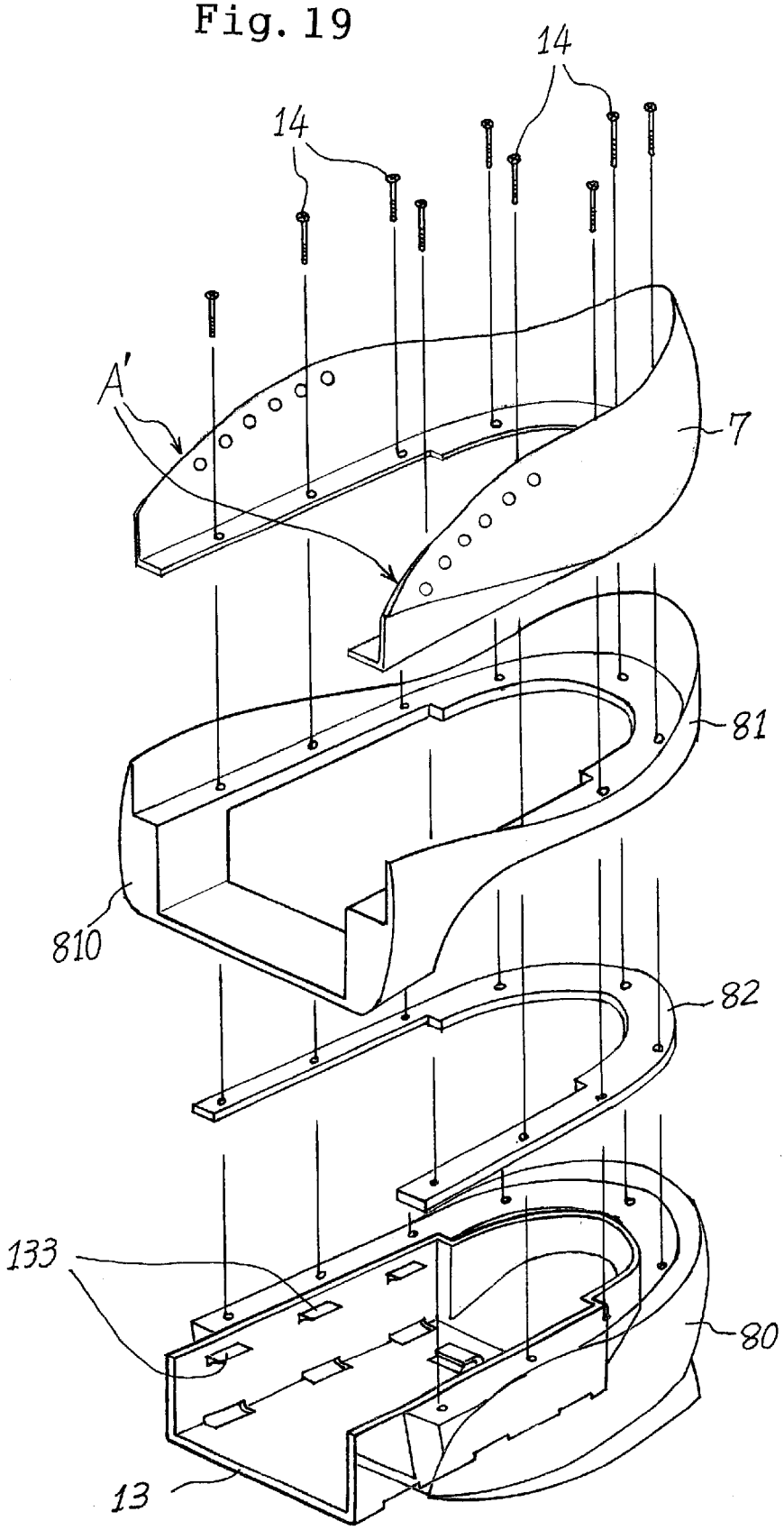
FIG. 19 is a perspective view showing a preferable form of connection for the members of the rearfoot part in the embodiment shown in FIG. 12.

Basically, the rearfoot outsole 80, the fixing plate 82, the rearfoot midsole 81 and the rearfoot upper 7 can be joined together by any method, and this outsole 80 and the pedestal 13 can be joined together by any method. These methods may be adhesion with an adhesive, connection with screws or stitching. For easy replacement of the outsole 80, the prevention of it from falling out, and other reasons, it is particularly preferable that, as shown in FIG. 19, the parts be joined by a method that includes the steps of bonding the fixing plate 82 to the top of the outsole 80 of rubber with an adhesive, and then connecting the midsole 81 and the upper 7 to the bonded plate 82 and the outsole 80 with screws 14 screwed from above the upper 7.

By the foregoing process, the forefoot and rearfoot parts 1 and 2 are formed that are the divisions of the shoe body on the front and rear sides of the arch (the middle 4 of the arch in this embodiment) of the shoe sole, as shown in FIG. 12.

Subsequently, the male and female members A1 and A2 of the fasteners 11 are engaged to detachably connect the adjacent edges of the uppers 5 and 7. In the meantime, the male and female members B1 and B2 of the fastener 12 are engaged to detachably connect the adjacent ends of the soles 6 and 8. This connects the forefoot and rearfoot parts 1 and 2 together, forming the shoe body. Next, the innersole 3 is laid in the shoe body. This completes the shoe.

In this embodiment as well, as stated already, it is possible to produce sorts of shoes of different widths for each size by forming (making) forefoot parts 1 of different widths and/or rearfoot parts 2 of different widths, selecting any of the parts 1 and/or 2 of different widths, and connecting the parts 1 and 2 as stated above.

It is possible to produce sorts of shoes each pair of which has different sizes and/or widths by forming (making) forefoot parts 1 of different sizes and/or widths and/or rearfoot parts 2 of different sizes and/or widths, selecting any of the parts 1 and/or 2 of different sizes and/or widths, and connecting the parts 1 and 2 as stated above.

All of the forefoot upper 5, the forefoot sole 6 (outsole 60 and midsole 61), the rearfoot upper 7 and the rearfoot sole 8 (outsole 80 and midsole 81) of each shoe may be made of resin. The resinous parts 5–8 may be joined with an adhesive so that a forefoot part 1 and a rearfoot part 2 may be formed. In this case, if any of the parts 5–8 is damaged or worn, its adhesive joint can be torn off for replacement of it.

Figure 20:
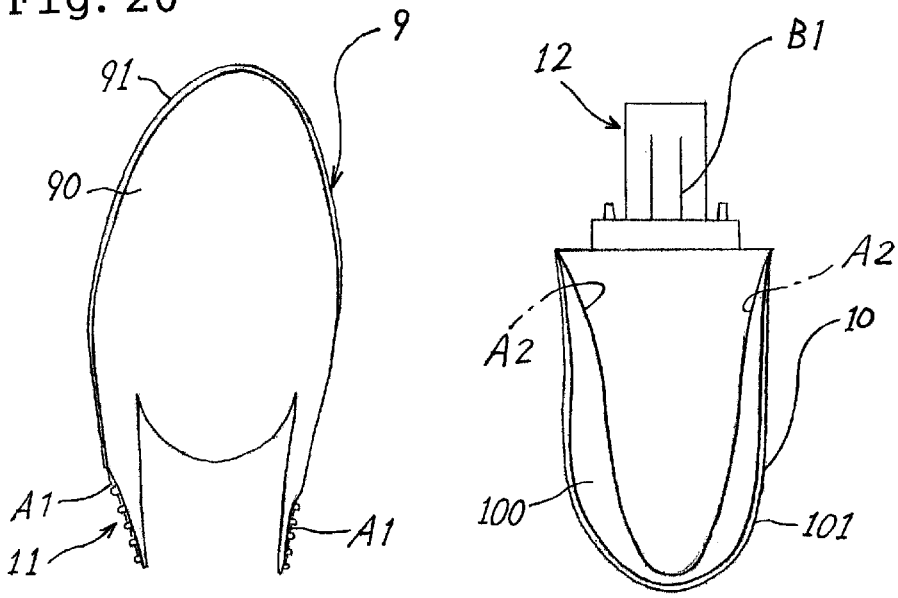
FIG. 20 is a perspective view of the forefoot and rearfoot parts of the shoe in an embodiment of a second aspect of the present invention, showing the parts in a condition before production.
Figure 21:
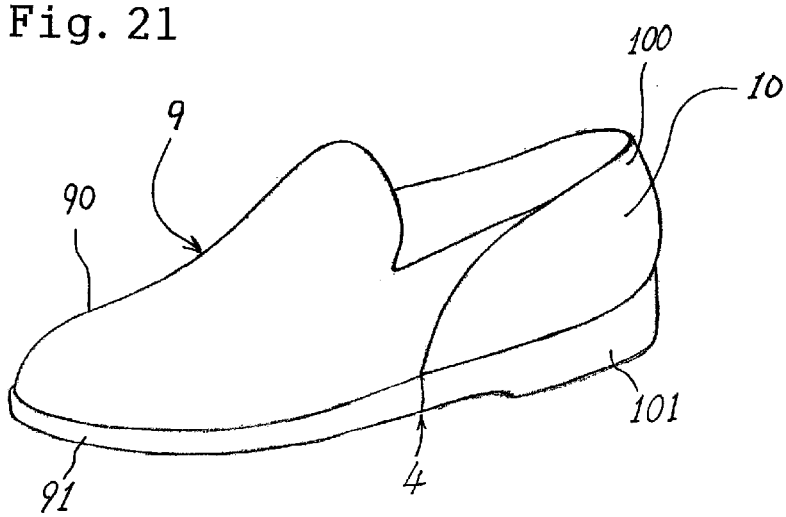
FIG. 21 is a perspective view of the shoe produced in the embodiment shown in FIG. 20.

FIGS. 20 and 21 show an embodiment of a shoemaking method according to a second aspect of the present invention and a shoe made by this method. FIG. 20 is a plan view of the forefoot and rearfoot parts of the shoe before production. FIG. 21 is a perspective view of the produced shoe.

The shoe shown in FIG. 20 consists of an integral forefoot part 9, an integral rearfoot part 10 and an innersole (not shown) The integral parts 9 and 10 are divisions on the front and rear sides of a position in the arch (the middle 4 of the arch in this embodiment) of the shoe body. The innersole is laid in the formed shoe body.

A process for fabricating a shoe from these parts includes the step of forming the forefoot part 9 by integrally molding a forefoot upper 90 and a forefoot sole 91. This process also includes the step of forming the rearfoot part 10 by integrally molding a rearfoot upper 100 and a rearfoot sole 101.

The forefoot upper 90 and sole 91 are integrally molded from thermoplastic resin, thermosetting resin or the like. The rearfoot upper 100 and sole 101 are integrally molded from thermoplastic resin, thermosetting resin or the like.

The uppers 90 and 100 include fasteners 11 as connecting means each for detachably connecting their adjacent edges on one side. The fasteners 11 are similar to those in the embodiment shown in FIGS. 1–9. The structure of the fasteners 11, the ways of fitting and engaging them, etc. are identical with those of that embodiment, and therefore will not be described in detail.

The soles 91 and 101 include a fastener 12 as a connecting means for detachably connecting their adjacent ends. The fastener 12 is similar to that in the embodiment shown in FIGS. 1–9. The structure of the fastener 12, the ways of fitting and engaging it, etc. are identical with those of that embodiment, and therefore will not be described in detail.

The male and female members A1 and A2 of the fasteners 11 and the male and female members B1 and B2 of the fastener 12 may be set in the molds to be fitted and fixed at the same time that the members of the forefoot and rearfoot parts 9 and 10 are integrally molded. Alternatively, the male and female members may be fitted to the molded parts 9 and 10.

The fasteners 11 and 12 might alternatively be identical with those of the embodiment shown in FIGS. 10–18.

After the forefoot and rearfoot parts 9 and 10 are formed by the foregoing process, they are joined with the fasteners 11 and 12. Specifically, the fasteners 11 detachably connect the adjacent edges of the forefoot and rearfoot uppers 90 and 100. In the meantime, the fastener 12 detachably connects the adjacent ends of the forefoot and rearfoot soles 91 and 101. This connects the forefoot and rearfoot parts 9 and 10 together, forming the shoe body. Next, the innersole (not shown) is laid in the shoe body. This completes the shoe as shown in FIG. 21.

By the foregoing shoemaking process according to this method, ready-made shoes fitting an individual's foot shape can be made as follows. The production of shoes of an arbitrary size involves forming (making) forefoot parts 9 of different widths and/or rearfoot parts 10 of different widths. The production also involves selecting any of the parts 9 and/or 10 of different widths and connecting the parts 9 and 10 as stated above. This makes it possible to produce sorts of shoes of different widths for each size. By way of example, if five sorts of forefoot parts 9 of different widths and three sorts of rearfoot parts 10 of different widths are made, it is possible to produce fifteen sorts of shoes of different widths for each size.

The production of a pair of shoes of different sizes and/or widths involves forming (making) forefoot parts 9 of different sizes and/or widths and/or rearfoot parts 10 of different sizes and/or widths. The production also involves selecting any of the parts 9 and/or 10 of different sizes and/or widths and connecting the parts 9 and 10 as stated above. This makes it possible to produce sorts of shoes each pair of which has different sizes and/or widths.

Thus, this method makes it possible to easily produce sorts of shoes of different widths for each size and a pair of shoes of different sizes and/or widths by forming some sorts of forefoot parts 9 and/or rearfoot parts 10 of different widths and/or the like and suitably combining them.

The forefoot and rearfoot parts 9 and 10 of each shoe made by this method can be separated anytime. Even if one of the parts 1 and 2 is damaged or worn, it can be replaced easily.

This method can be applied to not only shoes but also sandals.

Figure 22:
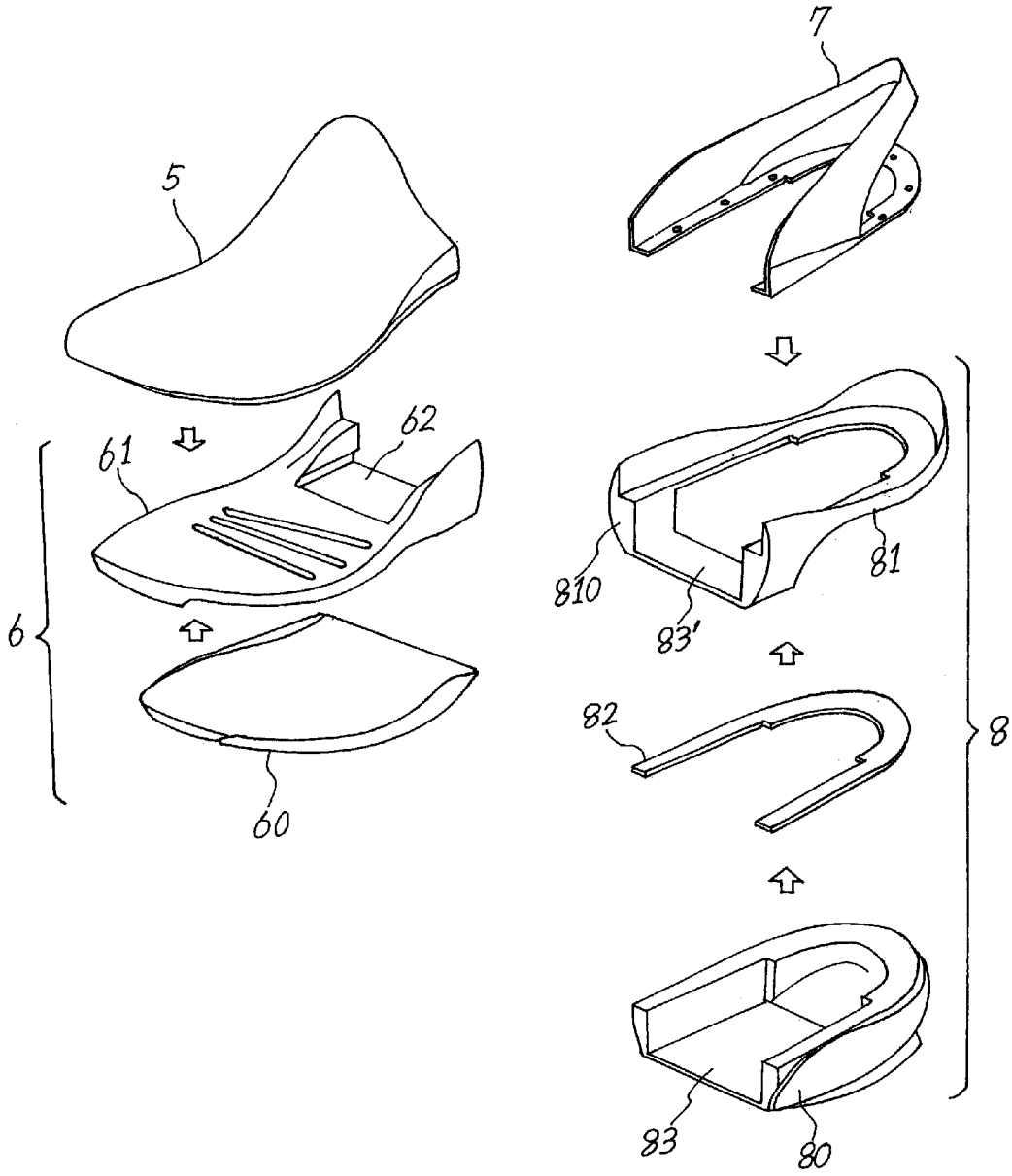
FIG. 22 is a perspective view of the members of the forefoot and rearfoot parts of a sandal to which the present invention is applied.

FIG. 22 is a perspective view of the members of the forefoot and rearfoot parts of a sandal to which the present invention is applied. Because the forefoot and rearfoot uppers 5 and 7 of the sandal are originally separate, it includes no connecting means for connecting them, which would correspond to the fasteners 11 of the embodiments shown in FIGS. 1–9 and 10–18. The sandal includes a fastener 12 (not shown) as a connecting means for connecting the forefoot and rearfoot soles 6 and 8. The fastener 12 is similar to those of the embodiments shown in FIGS. 1–9 and 10–18.

The shoe (sandal) shown in FIG. 22 consists of a forefoot upper 5, a rearfoot upper 7, a forefoot sole 6, a rearfoot sole 8 and an innersole (not shown). The soles 6 and 8 are divisions on the front and rear sides of a position in the arch (the middle 4 of the arch in this embodiment) of the shoe body. The innersole is laid in the formed shoe body. The forefoot sole 6 consists of a forefoot outsole 60 and a forefoot midsole 61. The rearfoot sole 8 consists of a rearfoot outsole 80, a rearfoot midsole 81 and a sole fixing plate 82, which is interposed between them.

These parts or members of this shoe are quite similar in structure to those of the embodiment shown in FIGS. 10–18, except that the shoe includes no connecting means (fasteners 11) for connecting the forefoot and rearfoot uppers 5 and 7. Accordingly, a process of production according to this method is quite similar to that of the embodiment shown in FIGS. 10–18, except that this process includes no step of connecting the uppers 5 and 7. Specifically, the process includes the steps of joining the forefoot upper 5 to the forefoot sole 6 to form a forefoot part 1, joining the rearfoot upper 7 to the rearfoot sole 8 to form a rearfoot part 2, and detachably joining the soles 6 and 8 with the connecting means (for example, fastener 12) to connect the parts 1 and 2, thereby forming a shoe body. The innersole (not shown) is laid in the formed shoe body.

A sandal may be produced by integrally molding a forefoot part and a rearfoot part. In this case, as is the case with the embodiment shown in FIGS. 20 and 21 (the same reference numerals will be used below as in FIGS. 20 and 21), the shoe consists of an integral forefoot part 9, an integral rearfoot part 10, and an innersole. The integral parts 9 and 10 are divisions on the front and rear sides of a position in the arch (for example, the middle 4 of the arch) of the shoe body. The innersole is laid in the formed shoe body.

These parts or members of this shoe are quite similar in structure to those of the embodiment shown in FIGS. 20–21, except that the sandal includes no connecting means (fasteners 11) for connecting the forefoot and rearfoot uppers 90 and 100. Accordingly, a process of production according to this method is quite similar to that of the embodiment shown in FIGS. 20–21, except that this process includes no step of connecting the uppers 90 and 100. Specifically, the process includes the steps of integrally molding the forefoot upper 90 and sole 91 to form a forefoot part 9, integrally molding the rearfoot upper 100 and sole 101 to form a rearfoot part 10, and detachably joining the soles 91 and 101 with a connecting means (for example, fastener 12) to connect the parts 9 and 10, thereby forming a shoe body. The innersole is laid in the formed shoe body.

It is possible to produce sorts of such sandals of different widths for each size by, as stated already, forming (making) forefoot parts 1 of different widths and/or rearfoot parts 2 of different widths, selecting any of the parts 1 and/or 2 of different widths, and connecting the parts 1 and 2 as stated above.

It is also possible to produce sorts of sandals each pair of which has different sizes and/or widths by forming (making) forefoot parts 1 of different sizes and/or widths and/or rearfoot parts 2 of different sizes and/or widths, selecting any of the parts 1 and/or 2 of different sizes and/or widths, and connecting the parts 1 and 2 as stated above.

FIGS. 23–29 show another embodiment of the fastener 12 for connecting the forefoot and rearfoot soles. In each of the foregoing embodiments, part of the male member B1 elastically deforms so that the male and female members B1 and B2 can detachably engage. In this embodiment, the male and female members B1 and B2 have such structures that they can detachably engage without elastically deforming. These structures increase the joining (engaging) strength between the members B1 and B2 in comparison with the foregoing embodiments.

Figure 23:
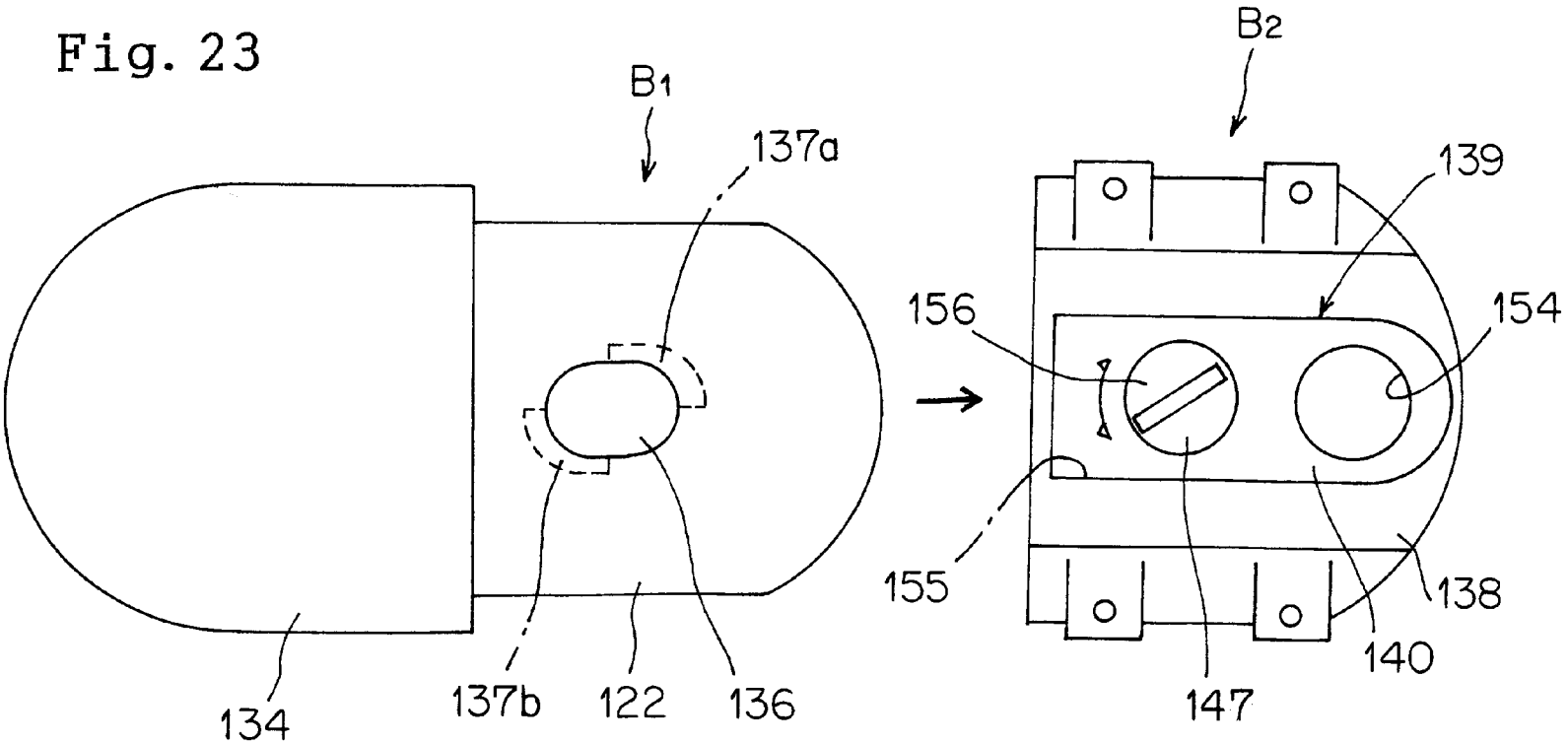
FIG. 23 is a plan view of another embodiment of the fastener for connecting the forefoot and rearfoot soles, and shows the fastener in disengaged condition.
Figure 24:
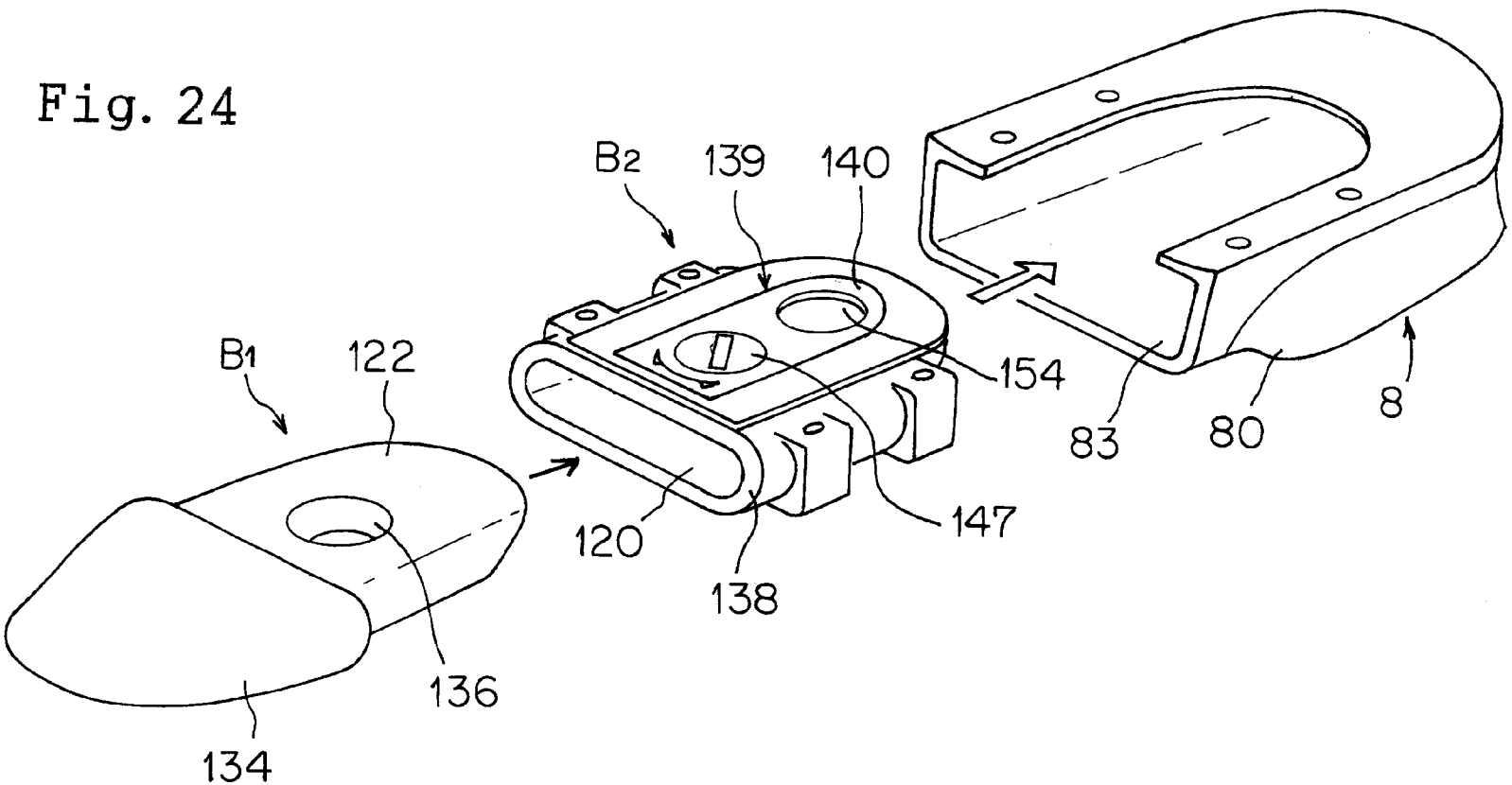
FIG. 24 is a perspective view of the fastener shown in FIG. 23, and shows the fastener in disengaged condition.
Figure 25:
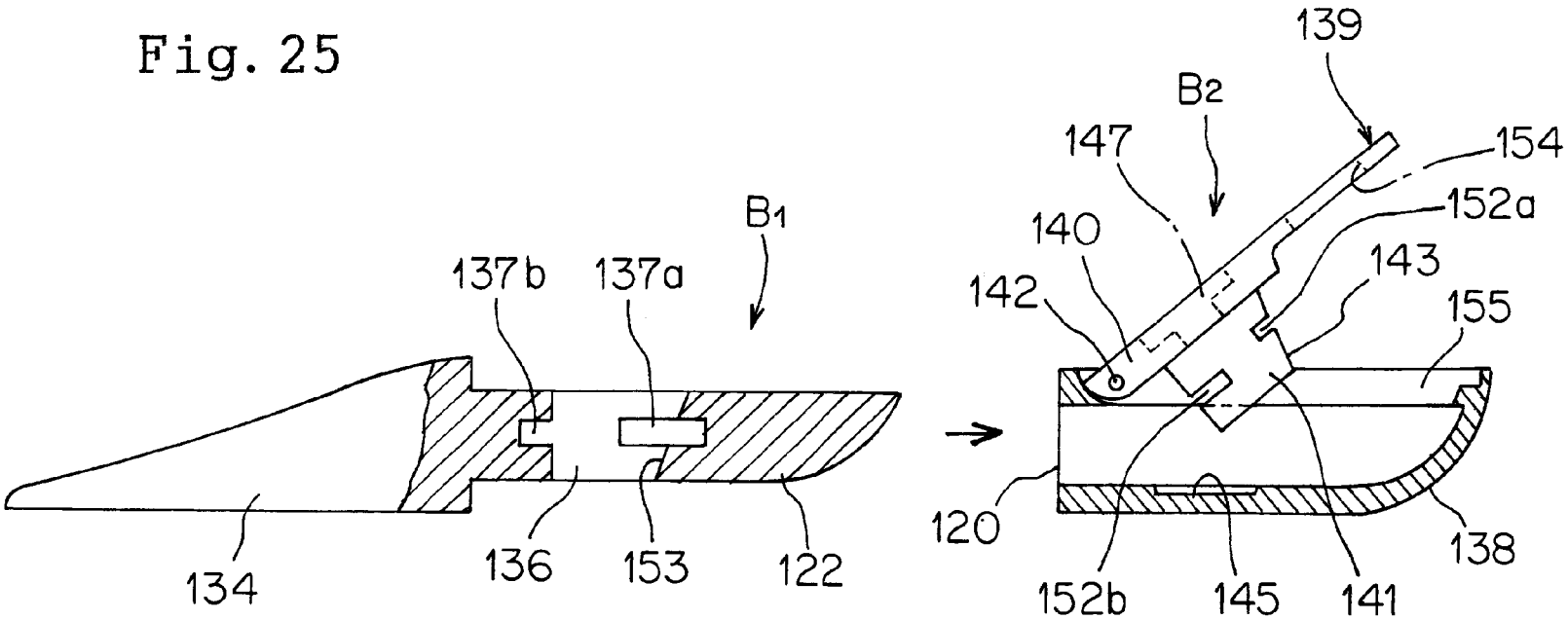
FIG. 25 is a side view partially in section of the fastener shown in FIG. 23, and shows the fastener in disengaged condition.
Figure 26:
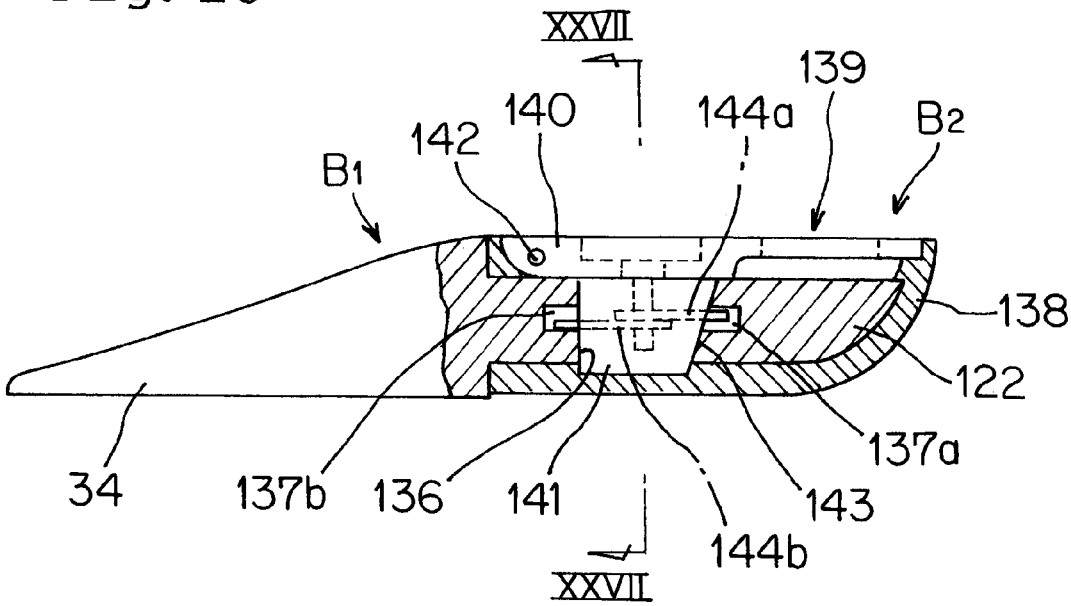
FIG. 26 is a side view partially in section of the fastener shown in FIG. 23, and shows the fastener in engaged condition.
Figure 27:
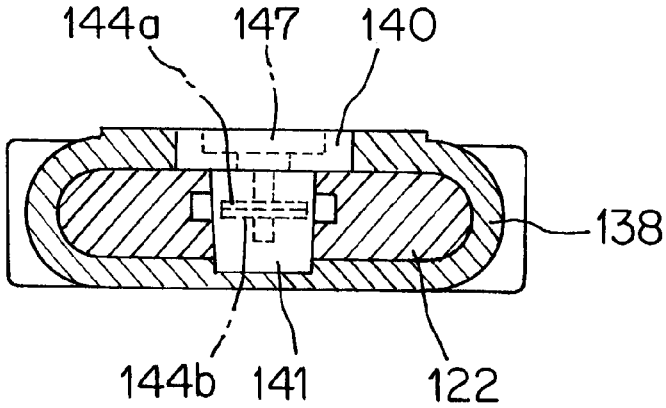
FIG. 27 is a cross section taken along the line XXVII—XXVII of FIG. 26.
Figure 28:
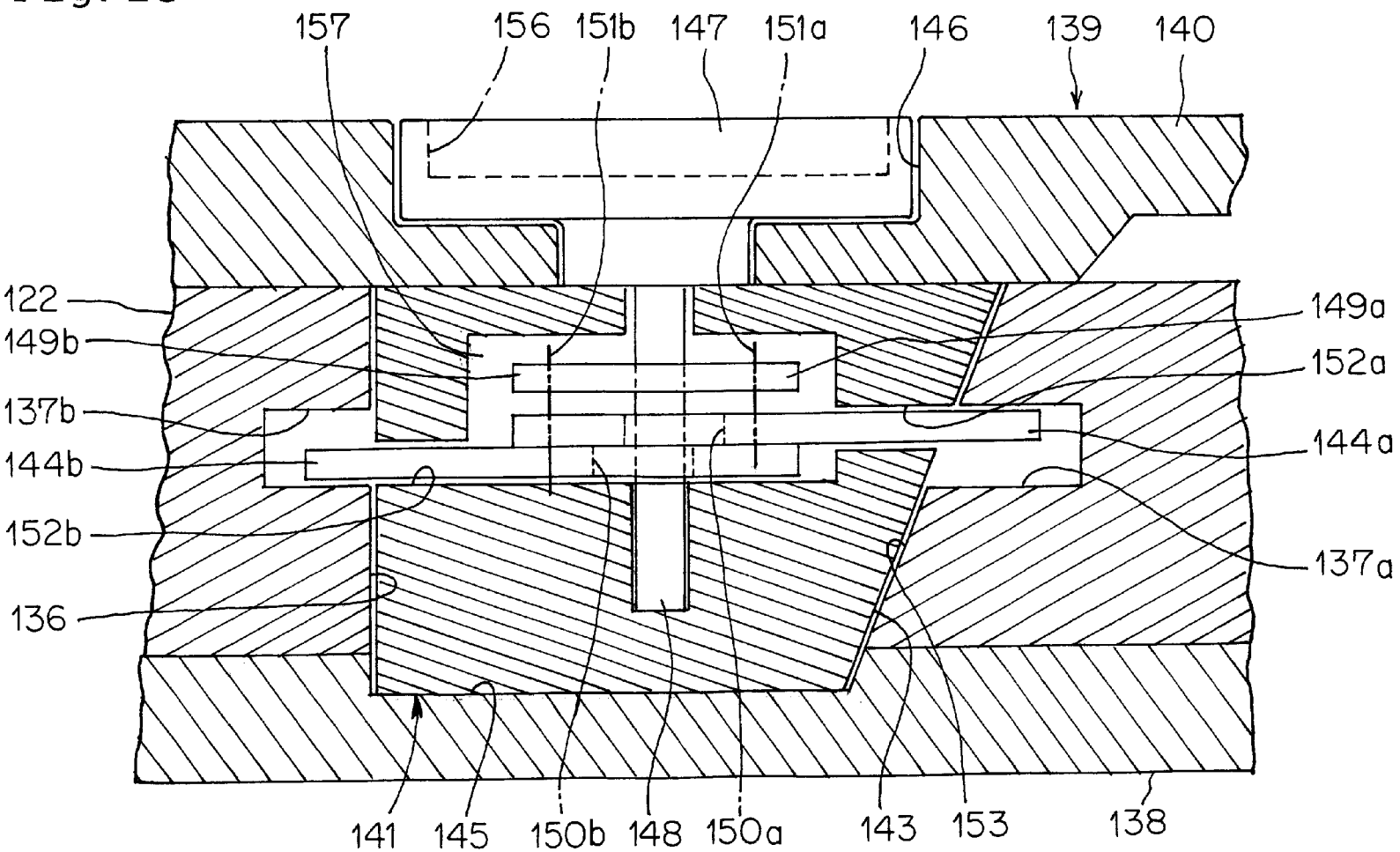
FIG. 28 is a cross section partially showing the stopper of the female member of the fastener shown in FIG. 23.
Figure 29:
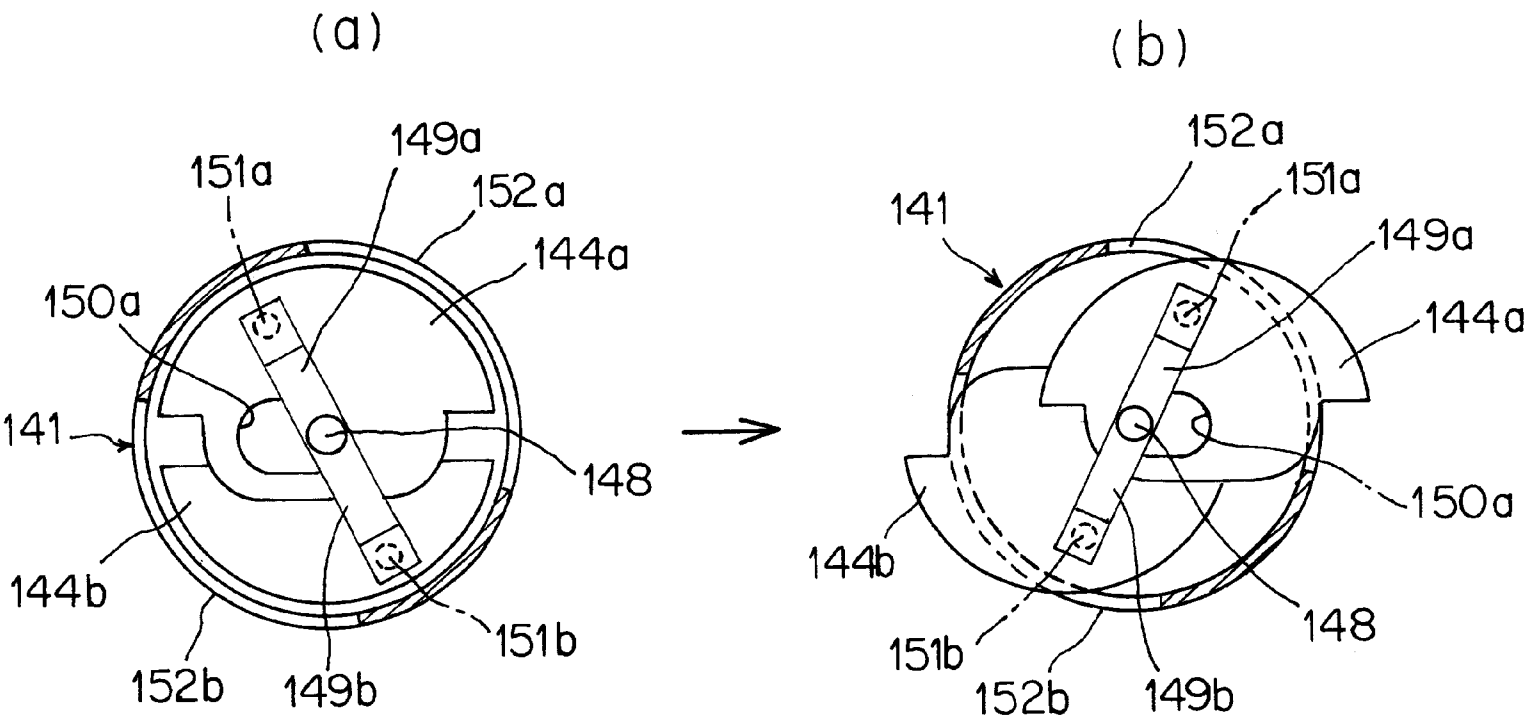
FIG. 29 is an explanatory view showing a mechanism for locking the stopper of the fastener shown in FIG. 23. This view also shows how the mechanism operates.

FIG. 23 is a plan view of this fastener in disengaged condition. FIG. 24 is a perspective view of the fastener in disengaged condition. FIG. 25 is a side view partially in section of the fastener in disengaged condition. FIG. 26 is a side view partially in section of the fastener in engaged condition. FIG. 27 is a cross section along the line XXVI-I–XXVII of FIG. 26. FIG. 28 is a cross section partially showing the stopper of the female member of the fastener. FIG. 29 is an explanatory view showing a mechanism for locking the stopper and how the mechanism operates.

As is the case with the embodiments shown in FIGS. 1–9 and 10–18, this fastener 12 consists of a male member B1 and a female member B2. The female member B2 is provided in one of the adjacent ends of the forefoot and rearfoot soles (the front end of the rearfoot sole in this embodiment). The male member B1 is provided for the other end (the rear end of the forefoot sole in this embodiment). The members B1 and B2 may be made of metal or industrial plastic (for example, polyacetal) that is high in strength, shock (impact) resistance, abrasive resistance, etc. so that they can function as the shank of the shoe sole. The soles, which are not shown, are similar in structure to those of the embodiments shown in FIGS. 1–9 and 10–18.

This fastener 12 is described below as substituted for that shown in FIGS. 10–18.

As is the case with the embodiment shown in FIGS. 10–18, the male member B1 consists of a front end part 134 and a main body 122. The end part 134 is fixed to the forefoot sole 6, with the main body 122 protruding from that end of this sole 6 which should be connected to the rearfoot sole 8. The main body 122 takes the form of a tongue and has an oval hole 136 formed through its approximate center. The oval hole 136 has a rear surface 153, which inclines in such a manner that this hole 136 is smaller downward in diameter. The oval hole 136 also has two lock grooves 137*a* and 137*b* formed in two surfaces thereof opposite at 180 degrees (diametrically) to each other. As stated later on, the female member B2 includes a lock plate, part of which can engage with the lock grooves 137*a* and 137*b*.

The female member B2 takes the form of a case having an open end 120, through which the main body 122 of the male member B1 can be inserted into the female member B2. The female member B2 is put wholly in the recess 83 of the rearfoot outsole 80 of the rearfoot sole 8, with its open end 120 positioned at that end of this sole 8 which should be connected to the forefoot sole 6.

The female member B2 includes main body 138 and a stopper 139. The main body 138 has the open end 120 and an opening 155 formed through its top. The stopper 139 can pivot up and down through the opening 138. The stopper 139 includes a main plate 140 and an engaging member 141 protruding from the bottom of this plate 140. The main body 138 supports one end of the main plate 140 at that end of the opening 155 which is adjacent to the open end 120, in such a manner that the stopper 139 can pivot up and down on an axis 142. When the stopper 139 pivots downward, it closes the opening 155.

The engaging member 141 has a cavity 157 formed in it. The engaging member 141 is oval in horizontal section and has a rear surface 143, which inclines in such a manner that this member 141 is smaller downward in diameter. The downward decreasing diameter enables the engaging member 141 to engage smoothly with the oval hole 136 of the male member B1 when the stopper 139 pivots downward. The bottom of the main body 138 of the female member B2 has a recess 145 formed on the inside, which engages with the bottom of the engaging member 141 when the stopper 139 pivots downward and closes the opening 155.

The stopper 139 includes a locking mechanism for locking the engaging member 141 engaging with the main body 122 of the male member B1. The locking mechanism includes lock plates 144*a* and 144*b* provided in the cavity 157 of the engaging member 141. The locking mechanism also includes the lock grooves 137*a*and 137*b* of the oval hole 136 of the male member B1. The locking mechanism further includes a lock plate operating mechanism for sliding the lock plates 144*a* and 144*b* into the lock grooves 137*a* and 137*b*, respectively. The engaging member 141 has slits 152*a* and 152*b* formed in its side, through which parts of the lock plates 144*a* and 144*b* in the cavity 157 can pass.

The main plate 140 of the stopper 139 has a fitting hole 146 formed through it over the engaging member 141. A disc 147 is supported rotatably in the fitting hole 146. A support shaft 148 is fixed to the bottom of the disc 147 and extends downward into the cavity 157. The bottom of the cavity 157 has a hole 158 formed in it, in which the bottom of the support shaft 148 is inserted rotatably. Support arms 149*a* and 149*b* are fixed to the support shaft 148 and extend horizontally on both sides in the cavity 157.

The lock plates 144*a* and 144*b* have a roughly semicircular or like shape and are formed with long holes 150*a* and 150*b*, respectively, through them, through which the support shaft 148 extends. The lock plates 144*a* and 144*b* are supported pivotably on pins 151*a* arid 151*b* by the support arms 149*a* and 149*b*, respectively. When the support shaft 148 is driven to turn the support arms 149*a* and 149*b* from their positions shown in FIG. 29 (*a*), the lock plates 144*a* and 144*b* shift horizontally. As shown in FIG. 29(*b*), parts of the horizontally shifting lock plates 144*a* and 144*b* pass through the slits 152*a* and 152*b*, respectively, and protrude from the engaging member 141 into the lock grooves 137*a* and 137*b*, respectively.

The main plate 140 of the stopper 139 has a hole 154 formed through it for opening and closing operation. The disc 147 has a groove 156 formed in it for engagement with a tool for turning the disc 147.

As stated already, the fastener 12, which consists of the male and female members B1 and B2, of this embodiment as well functions as the shank of the shoe sole. Therefore, the fastener 12 is made of materials as mentioned already, and is provided between the forefoot and rearfoot soles 6 and 8.

This fastener 12 detachably joins the adjacent ends of the soles 6 and 8, with the male member B1 and the female member B2 engaging together. The engagement involves turning the stopper 139 upward as shown in FIG. 25, inserting the main body 122 of the male member B1 in the female member B2 and then turning the stopper 139 downward. This, as shown in FIG. 26, brings the engaging member 141 of the stopper 139 into engagement with the oval hole 136 of the male member B1, and the bottom of the engaging member 141 into engagement with the recess 145 of the female member B2. Consequently, the engaging member 141 holds the main body 122 of the male member B1, preventing the male member B1 from coming out of the female member B2. The engaging member 141 might be kept simply in engagement with the oval hole 136 as stated above. In this embodiment, however, the locking mechanism locks the engaging member 141. The locking operation involves driving the support shaft 148 to turn the support arms 149*a* and 149*b* from their positions in FIG. 29(*a*) thereby horizontally shifting the lock plates 144*a* and 144*b*. As shown in FIG. 29(*b*), parts of the shifted lock plates 144*a* and 144*b* pass through the slits 152*a* and 152*b*, respectively, and protrude from the engaging member 141 into the lock grooves 137*a* and 137*b*, respectively. This locks the engaging member 141 in the oval hole 136.

It is possible to pull the male member B1 out of the female member B2 by driving the support shaft 148 in the opposite direction to turn the support arms 149*a* and 149*b* from their positions in FIG. 29(*b*), thereby retracting the lock plates 144*a* and 144*b* into the engaging member 141, as shown in FIG. 29(*a*), so that the engaging member 141 may be unlocked. After the engaging member 141 is unlocked, the stopper 139 is turned upward to disengage the engaging member 141 from the oval hole 136 of the male member B1. This releases the main body 122 of the male member B1 from the engaging member 141, allowing the male member B1 to be pulled easily out of the female member B2.

The foregoing preferred embodiments of the present invention are summarized below.

(1) Connecting means for connecting the forefoot upper 5 or 90 and rearfoot upper 7 or 100 of a shoe are fasteners 11 each provided at the adjacent edges of the uppers 5 and 7 or uppers 90 and 100 on one side. The fasteners 11 are any of the following a, b and c:

a. Protrusions 110 formed on one of the forefoot upper 5 or 90 and rearfoot upper 7 or 100, and holes 111 formed in the other for detachable engagement with the protrusions 110;

b. Magic tapes including parts fitted on the forefoot upper 5 or 90 and rearfoot upper 7 or 100;

c. Zippers including parts fitted on the forefoot upper 5 or 90 and rearfoot upper 7 or 100.

(2) A connecting means for connecting the forefoot sole 6 or 91 and rearfoot sole 8 or 101 of a shoe is a fastener 12 consisting of a male member B1 and a female member B2, each of which is provided for one of the soles 6 and 8 or soles 91 and 101.

The fastener 12 is provided in the shoe sole and functions as a shank.

The male member B1 includes a main body, which protrudes from an end of a part (forefoot sole 6 or 91 or rearfoot sole 8 or 101) of the sole.

The female member B2 is provided in another part (rearfoot sole 8 or 101 or forefoot sole 6 or 91) of the sole and has an opening 120, through which the male member B1 can be inserted into the female member B2. The opening 120 is positioned at an end of this part (rearfoot sole 8 or 101 or forefoot sole 6 or 91) of the sole.

(3) In the embodiment (2), the forefoot sole 6 or 91 includes a forefoot outsole 60 and a forefoot midsole 61. The male member B1 or female member B2 of the fastener 12 is fixed to the forefoot midsole 61.

(4) In the embodiment (2) or (3), the rearfoot sole 8 or 101 includes a rearfoot outsole 80 and a rearfoot midsole 81. The female member B2 or male member B1 of the fastener 12 is fixed to the rearfoot outsole 80.

(5) In the embodiment (4), a pedestal 13 for housing the fastener is fixed to the rearfoot outsole 80. The female member B2 or male member B of the fastener 12 is fixed detachably to the pedestal 13.

(6) In any one of the embodiments (2)–(5), the male member B1 of the fastener 12 includes an elastically deformable stopper 123 or 125, which engages detachably with part of the female member B2 when the male member B1 is inserted into the female member B2.

(7) In the embodiment (6), the stopper 125 is supported by a support member (arm) 124. The stopper 125 or the support member 124 can elastically deform up and down. The main body of the male member B can be inserted into the female member B2, with the stopper 125 or the support member 124 elastically deformed. The female member B2 has a hole 127 formed through its top. When the main body of the male member B1 is inserted in the female member B2, the hole 127 releases the stopper 125 or the support member 124 from elastic deformation and engages with the stopper 125. The stopper 125 engaging with the hole 127 can be pressed from the inside of the shoe downward out of the hole.

(8) In the embodiment (7), the female member B2 includes a slidable stopper 129 for engaging detachably with the bottom of the stopper 125 in engagement with the hole 127 to hold the stopper 125 in the hole 127.

(9) In any one of the embodiments (2)–(5), the main body 122 of the male member B1 has a generally vertical hole 136 formed through it, and the female member B2 includes a main body 138 and a stopper 139. The main body 138 has an opening 155 formed in its top. The stopper 139 is provided at the opening 155 in such a manner that it can pivot up and down. The stopper 139 includes a main plate 140 and an engaging member 141. The main plate 140 is supported pivotably by the main body 138. The engaging member 141 protrudes from the bottom of the main plate 140. When the stopper 139 is caused to pivot upward, the main body 122 of the male member B1 can be inserted in the female member B2. Thereafter, the downward pivotal movement of the stopper 139 engages the engaging member 141 with the hole 136 of the inserted male member B1.

(10) In the embodiment (9), the engaging member 141 of the female member b2 and the hole 136 of the male member B1 are smaller downward in diameter.

(11) In the embodiment (9) or (10), the hole 136 of the male member B1 has a lock groove 137 formed in it, and the engaging member 141 of the female member B2 is hollow and has a slit 152 formed in it. The female member B2 includes a lock plate 144, which can horizontally move in the hollow engaging member 141 in such a manner that part of this plate 144 can protrude from and retract into the slit 152. When the engaging member 141 engages with the hole 136 of the male member B1, part of the lock plate 144 can protrude through the slit 152 from the engaging member 141 into the lock groove 137 of the male member B1, locking the engaging member 141 in engagement with the hole 136.

(12) In any one of the embodiments (9)–(11), the bottom of the main body 138 of the female member B2 has a recess 145 formed on the inside. When the stopper 139 pivots downward and closes the opening 155, the bottom of the engaging member 141 engages with the recess 145.

(13) In the embodiment (11) or (12), the stopper 139 includes an operating mechanism for horizontally moving the lock plate 144 to protrude part of this plate 144 from and retract it into the slit 152.

What is claimed is:

1. A method for making a shoe including a forefoot upper, a rearfoot upper, a forefoot sole, a rearfoot sole, an arch and an innersole, the forefoot and rearfoot uppers being divisions on the front and rear sides, respectively, of said arch of the shoe body, the forefoot and rearfoot soles being other divisions on the front and rear des, respectively, of the arch, and the innersole being laid in the formed shoe body, the method comprising the steps of: forming a forefoot part by joining the forefoot upper to the forefoot sole; forming a rearfoot part by joining the rearfoot upper to the rearfoot sole; and forming the shoe body by connecting the forefoot and rearfoot parts by detachably connecting the uppers of the forefoot and rearfoot parts with first means for connecting and detachably connecting the soles of the forefoot and rearfoot parts with second means for connecting; wherein the step of forming the shoe body comprises connecting desired forefoot and rearfoot parts selected from among a plurality of forefoot and/or rearfoot parts different in width.

2. A method for making a shoe including a forefoot upper, a rearfoot upper, a forefoot sole, a rearfoot sole, an arch and an innersole, the forefoot and rearfoot uppers being divisions on the front and rear sides, respectively, of said arch of the shoe body, the forefoot and rearfoot soles being other divisions on the front and rear sides, respectively, of said arch, and the innersole being laid in the formed shoe body, the method comprising the steps of: forming a forefoot part by joining the forefoot upper to the forefoot sole; forming a rearfoot part by joining the rearfoot upper to the rearfoot sole; and forming the shoe body by connecting the forefoot and rearfoot parts by detachably connecting the uppers of the forefoot and rearfoot parts with first means for connecting and detachably connecting the soles of the forefoot and rearfoot parts with second means for connecting; wherein the step of forming the shoe body is to connect desired forefoot and rearfoot parts selected from among a plurality of forefoot and/or rearfoot parts different in size and/or width.

3. A method according to claim 1 or 2 wherein the connecting means for the forefoot and rearfoot uppers is a fastener including parts provided for the uppers.

4. A method according to claim 1 or 2 wherein the connecting means for the forefoot and rearfoot soles is a fastener including parts provided for the soles, the fastener functioning as a shank.

5. A method according to claim 1 or 2 for making sorts of shoes of different widths for any one size by forming a plurality of the forefoot parts of different widths and/or a plurality of the rearfoot parts of different widths, selecting any of the parts of different widths and connecting the forefoot and rearfoot parts.

6. A method according to claim 1 or 2 for making sorts of shoes each pair of which has different sizes and/or widths by forming a plurality of the forefoot parts of different sizes and/or widths and/or a plurality of the rearfoot parts of different sizes and/or widths, selecting any of the parts of different sizes and/or widths and connecting the forefoot and rearfoot parts.

* * * * *